US006139929A

United States Patent [19]

Hayton et al.

[11] Patent Number: 6,139,929

[45] Date of Patent: Oct. 31, 2000

[54] SOCKS

[75] Inventors: Karen C. Hayton, Northampton; Ian Stirling, Norfolk, both of United Kingdom

[73] Assignee: Porvair PLC, Norfolk, United Kingdom

[21] Appl. No.: 09/389,538

[22] Filed: Sep. 3, 1999

Related U.S. Application Data

[63] Continuation of application No. PCT/GB98/00567, Feb. 23, 1998.

[60] Provisional application No. 60/044,123, Apr. 22, 1997.

[30] Foreign Application Priority Data

Mar. 7, 1997 [GB] United Kingdom ..... 9704792

[51] Int. Cl.[7] ..... B29D 22/00

[52] U.S. Cl. ..... 428/35.2; 428/36.1; 428/196; 428/197; 428/198; 66/178 R; 66/190; 2/239

[58] Field of Search ..... 428/35.2, 36.1, 428/196, 197, 198; 66/178 R, 190; 2/239

[56] References Cited

U.S. PATENT DOCUMENTS

| | | |
|---|---|---|
| 4,194,041 | 3/1980 | Gore . |
| 4,310,373 | 1/1982 | Schuhmacher et al. . |
| 4,430,759 | 2/1984 | Jackrel . |
| 4,443,511 | 4/1984 | Worden et al. . |
| 4,520,056 | 5/1985 | Jackrel . |
| 4,539,256 | 9/1985 | Shipman . |
| 4,545,841 | 10/1985 | Jackrel . |
| 4,550,446 | 11/1985 | Herman . |
| 4,613,544 | 9/1986 | Burleigh . |
| 4,636,424 | 1/1987 | Amemiya et al. . |
| 4,679,257 | 7/1987 | Town . |
| 4,761,324 | 8/1988 | Rautenberg et al. . |
| 4,809,447 | 3/1989 | Pacanowsky . |
| 4,833,026 | 5/1989 | Kausch . |
| 4,967,494 | 11/1990 | Johnson . |
| 4,981,747 | 1/1991 | Morman . |
| 5,244,716 | 9/1993 | Thornton et al. ..... 428/198 |
| 5,415,924 | 5/1995 | Herlihy . |
| 5,418,044 | 5/1995 | Mahler . |
| 5,430,896 | 7/1995 | Bisley . |
| 5,483,703 | 1/1996 | Williams . |
| 5,529,830 | 6/1996 | Dutta et al. . |
| 5,655,226 | 8/1997 | Williams . |
| 5,832,539 | 11/1998 | Williams . |

FOREIGN PATENT DOCUMENTS

| | | |
|---|---|---|
| 0110627 | 6/1984 | European Pat. Off. . |
| 0415758 | 3/1991 | European Pat. Off. . |
| 2074093 | 10/1981 | United Kingdom . |
| 2155853 | 10/1985 | United Kingdom . |
| 2211141 | 6/1989 | United Kingdom . |
| 89/04611 | 6/1989 | WIPO . |
| 89/07523 | 8/1989 | WIPO . |
| 92/07480 | 5/1992 | WIPO . |
| 93/21013 | 10/1993 | WIPO . |
| 94/08477 | 4/1994 | WIPO . |
| 97/16082 | 5/1997 | WIPO . |
| 98/39982 | 9/1998 | WIPO . |

*Primary Examiner*—Christopher Raimund
*Attorney, Agent, or Firm*—Patterson, Thuente & Skaar, P.A.

[57] ABSTRACT

There is disclosed a composite sock which consists of an inner stretchable fabric envelope, a bag-like barrier component which is liquid water impermeable, and water vapour permeable, and a second or outer stretchable fabric envelope. The inner envelope is attached to the barrier component, the barrier component is attached to the outer envelope, the arrangement being such as to allow circumferential stretching of the composite sock. The inner stretchable fabric envelope or the outer stretchable fabric envelope or both is a circular knitted sock. The composite sock has elastic properties such that it can be stretched at least in the X direction to at least 50% extension, and such that when a sample taken from the leg of the composite sock just above the ankle, the sample being 5 cm by 10 cm with the 10 cm dimension aligned in the X direction is extended on a tensometer at 100 mm per minute to 15 cms length (i.e. by 50%) and is allowed to recover at 100 mm/minute (producing a hysteresis curve) the load at 25% extension during the recovery stage is at least 50% of the load at 25% extension during the stretching stage.

57 Claims, 24 Drawing Sheets

SOCKS

This application is a continuation of PCT/GB98/00567, filed Feb. 23, 1998. This application claims benefit of provisional application Ser. No. 60/044,123, filed Apr. 22, 1997.

The present invention relates to socks which are close fitting to the foot and ankle and lower leg at least and which are resistant to penetration by liquid water, whilst permitting egress from the foot of water vapour.

U.S. Pat. No. 5,244,716 discloses structures achieving these objectives but it is desirable to improve upon such structures, in particular as regards closeness of fit and ease of drawing onto and off the foot and durability to repeated drawing onto and off the foot.

Searches have revealed the following documents relating to stretchable socks; WO 95/32093 (W. L. Gore), WO 94/08477 (Williams), WO 89/07523 (Porvair) (which corresponds to U.S. Pat. Nos. 5,244,716 mentioned above), 5,430,896 (Bisley), 4,809,447 (Pacanowsky), 4,761,324 (Rautenberg) et al) and 4,443,511 (Worden et al assigned to W. L. Gore).

The applicants are also aware of the following documents. WO 93/21013 (W. L. Gore), (and corresponding EP 636065 (W. L. Gore) and GB 2074093 (W. L. Gore)); U.S. Pat. No. 4,194,041 (W. L. Gore); GB 2155853 (Nitto); U.S. Pat. No. 5,402,540. (Williams), (corresponding to WO 94/08477 (Williams)); WO 89/4611 (W. L. Gore); U.S. Pat. No. 4,679,257 (Town); U.S. Pat. No. 4,430,759 (Jackrel); WO 92/07480 (W. L. Gore); U.S. Pat. Nos. 4,967,494 (Cabela's); 4,310,373 (Freudenberg); 4,935,287 (3M); 4,550,446 (Herman); 4,539,256 (Shipman); 4,833,026 (Kausch); 4,613,544 (3M); EP 110627B (W. L. Gore); U.S. Pat. Nos. 4,981,747 (Kimberley Clark) and 4,636,424 (Unitika) .

None of these documents disclose extensible socks having a circular knit sock and an attached waterproof breathable membrane the composite sock having the combination of properties possessed by the socks of the present invention or the structural features of elastic yarns laid-in in the X-direction in the knitted sock or reinforcement of the membrane against damaging extension in the toe-to-calf direction.

According to a first aspect of the present invention a composite sock consists of an inner stretchable sock, which is most preferably a circular knitted sock, a bag-like barrier component which is liquid water impermeable, and water vapour permeable, and an outer stretchable sock, which is most preferably a circular knitted sock, the inner sock being attached to the barrier component, the barrier component being attached to the outer sock, the arrangement, e.g. the attachment, being such as to allow circumferential stretching of the sock, the composite sock having elastic properties such that it can be stretched at least in the X direction to at least 50% extension, and such that when a sample taken from the leg of the sock just above the ankle, the sample being 5 cm by 10 cm with the 10 cm dimension aligned in the X direction, is extended at 100 mm per minute on a tensometer to 15 cms length i.e. by 50%, the load to stretch the sample to 50% extension (hereafter the 50% extension load) is less than 15N per 5 cm width, preferably less than 10N, more preferably less than 7.5N and most preferably 5N or less per 5 cm width.

According to a second aspect of the invention a composite sock consists of an inner stretchable sock, most preferably a circular knitted sock, a bag-like barrier component which is liquid water impermeable, and water vapour permeable, and an outer stretchable sock, most preferably a circular knitted sock, the inner sock being attached to the barrier component, the barrier component being attached to the outer sock, the arrangement, e.g. the attachment, being such as to allow circumferential stretching of the sock, the composite sock having elastic properties such that it can be stretched at least in the X direction to at least 50% extension, and such that when a sample taken from the leg of the sock just above the ankle, the sample being 5 cm by 10 cm with the 10 cm dimension aligned in the X direction, is stretched at 100 mm per minute on a tensometer to 15 cms length i.e. by 50%, on release of the pulling load in such a way that the sample recovers at 100 mm/minute, the sample recovers to within 12.5% (hereafter the recovery %) of its original 10 cms length, e.g. to within 10%, preferably to within 7.5%, e.g. to within 6%, and most preferably to within 5%.

According to a third aspect of the present invention a composite sock which consists of an inner stretchable sock, most preferably a circular knitted sock, a bag-like barrier component which is liquid water impermeable, and water vapour permeable, and an outer stretchable sock, most preferably a circular knitted sock, the inner sock being attached to the barrier component, the barrier component being attached to the outer sock, the arrangement, e.g. the attachment, being such as to allow circumferential stretching of the sock, the composite sock having elastic properties, such that it can be stretched at least in the X-direction to at least 50% extension and such that when a sample taken from the leg of the sock just above the ankle, the sample being 5 cm by 10 cm with the 10 cm dimension aligned in the X direction is stretched at 100 mm per minute on a tensometer to 15 cms length, i.e. by 50%, and allowed to recover at 100 mm/minute (producing a hysteresis curve) the load at 25% extension during the recovery stage is at least 50% of the load at 25% extension during the stretching stage (hereafter the power rating), e.g. 50–99 or 50–95%, preferably at least 60%, e.g. 65% to 95%, preferably 75% to 95% of the load at 25% extension during the stretching stage.

The invention also extends to a combination of the first and second aspects or the first and third aspects or the second and third aspects.

According to a preferred fourth aspect of the invention a composite sock consists of an inner stretchable sock, most preferably a circular knitted sock, a bag-like barrier component which is liquid water impermeable, and water vapour permeable and an outer stretchable sock, most preferably a circular knitted sock, the inner sock being attached to the barrier component, the barrier component being attached to the outer sock, the arrangement, e.g. the attachment, being such as to allow circumferential stretching of the sock, the composite sock having elastic properties such that it can be stretched at least in the X direction to at least 50% extension and such that when a sample taken from the leg of the sock just above the ankle, the sample being 5 cm by 10 cm with the 10 cm dimension aligned in the X direction is extended on a tensometer at 100 mm per minute to 15 cms length i.e. by 50%;

(i) the load to stretch the sample in the X direction to 50% extension (the 50% extension load) is less than 15N per 5 cm width, preferably less than 10N, more preferably less than 7.5N and most preferably 5N or less per 5 cm width, e.g. 0.1 to 6, preferably 0.1 to 5 e.g. 0.2 to 3.5 or 0.5 to 2.5N per 5 cm width;

(ii) on release of the pulling load, in such a way that the sample recovers at 100 mm/minute, the sample recovers to within 12.5% of it's original 10 cms length, e.g. to within 10%, preferably to within 7.5%, e.g. to within 6%, and most preferably to within 5% of its original 10 cms length; and (iii) when the sample is allowed to recover at 100 mm/minute (producing a hysteresis curve) the load at 25% extension during the recovery stage is at least 50% of the load at 25% extension during the stretching stage, e.g. 50–99 or 50–95%, preferably at least 60%, e.g. 65% to 95%, preferably 75% to 95% of the load at 25% extension during the stretching stage.

The 50% extension load has to be low enough to ensure that the composite sock can be drawn readily over the heel of the wearer without damage to the sock or strain or injury to the wearer. The recovery % defines the need for the sock to recover very substantially after being stretched over the heel so that a close fit is achieved; however this recovery must be achieved rapidly and the power rating reflects the rapidity with which the sock recovers towards its as-made dimensions.

The elastic properties of the composite sock may be provided by the inner sock or the outer sock or both. Thus the inner sock or the outer sock or both may have a 50% extension load of less than 7.5N, preferably in the range 0.1 to 6N per 5 cm width, more preferably 0.1 to 5 e.g. 0.2 to 3.5N or 0.5 to 2.5N. The inner sock or the outer sock or both may have a recovery % to within 12.5%, e.g. to within 10%, preferably to within 7.5%, e.g. to within 6% and most preferably to within 5%. The inner or outer sock or both preferably have a power rating of at least 50% and more preferably at least 60%.

Preferably the inner or outer sock or both have a 50% extension load of less than 3.5N, a recovery % of within 7.5% and a power rating of at least 60%, more preferably the 50% extension load is less than 2.5N, the recovery % is to within 5% and the power rating is 65% to 95%.

We have found that these properties especially in combination, permit ready drawing of the sock onto and off the foot whilst also ensuring close fit on the foot over repeated cycles of placing the sock on the foot.

According to a particularly preferred fifth aspect of the invention a composite sock consists of an inner stretchable sock, most preferably a circular knitted sock, a bag-like barrier component which is liquid water impermeable, and water vapour permeable, and an outer stretchable sock, most preferably a circular knitted sock, the inner sock being attached to the barrier component, the barrier component being attached to the outer sock, the arrangement, e.g. the attachment, being such as to allow circumferential stretching of the sock, the inner or the outer sock or both having elastic properties such that the composite sock has elastic properties such that it can be stretched at least in the X direction to at least 50% extension, and such that when a sample taken from the leg of the sock just above the ankle, the sample being 5 cm by 10 cm with the 10 cm dimension aligned in the X direction is extended on a tensometer at 100 mm per minute to 15 cms length i.e. by 50%;

(i) the load to stretch the sample in the X direction to at least 50% extension is less than 15N per 5 cm width, preferably less than ION, more preferably less than 7.5N and most preferably 5N or less per 5 cm width, e.g. 0.1 to 6, preferably 0.1 to 5 e.g. 0.2 to 3.5 or 0.5 to 2.5N per 5 cm width;

(ii) on release of the pulling load, in such a way that the sample recovers at 100 mm/minute, the sample recovers to within 12.5% of its original 10 cms length, e.g. to within 10%, preferably to within 7.5%, e.g. to within 6%, and most preferably to within 5% of its original 10 cms length; and (iii) when the sample is allowed to recover at 100 mm/minute (producing a hysteresis curve) the load at 25% extension during the recovery stage is at least 50% of the load at 25% extension during the stretching stage., e.g. 50–99 or 50–95%, preferably at least 60%, e.g. 65% to 95%, preferably 75% to 95% of the load at 25% extension during the stretching stage.

In a particularly preferred form of this aspect of the invention, the 50% extension load of the composite sock is less than 7.5N, the recovery % is to within 7.5% and the power rating is at least 60%, more preferably the 50% extension load is less than 5N, the recovery % is to within 5% and the power rating is 65% to 95%.

According to a further sixth aspect of the invention a composite sock consists of an inner circular knitted sock, a bag-like barrier component which is liquid water impermeable, and water vapour permeable, and an outer circular knitted sock, the inner sock being attached to the barrier component, the barrier component being attached to the outer sock, the attachment being such as to allow circumferential stretching of the sock, the inner or the outer sock or both having elastic yarns laid-in in X direction courses, i.e. circumferentially of the sock so that the ability of the sock when stretched laterally to recover to, or towards, its original unstretched shape and dimensions is enhanced.

By way of explanation it should be stated that a laid-in yarn is a yarn which does not form part of the stitches but rather is trapped between rows of stitches.

This structural arrangement is one preferred way of achieving the characteristics of the sock's behaviour described above.

In another seventh aspect of the invention a composite sock consists of an inner circular knitted sock, a bag-like barrier component which is liquid water impermeable, and water vapour permeable, and an outer circular knitted sock, the inner sock being attached to the barrier component, the barrier component being attached to the outer sock, the attachment being such as to allow circumferential stretching of the sock, the barrier component being corrugated when the sock is in the unstretched state, the inner surface of the barrier component carrying dots of adhesive which secure troughs of the corrugations in the corrugated barrier component to the outer surface of the inner sock, and the outer surface of the barrier component carrying dots of adhesive which secure peaks of the corrugations in the corrugated barrier component to the inner face of the outer sock.

This structure facilitates the achievement of a readily drawn-on and close fitting sock.

According to another eighth aspect of the present invention a composite sock consists of an inner stretchable sock, most preferably a circular knitted sock, a bag-like barrier component which is liquid waterimpermeable, and water vapour permeable, and an outer stretchable sock, most preferably a circular knitted sock, the inner sock being attached to the barrier component, the barrier component being attached to the outer sock, the arrangement, e.g. the attachment, being such as to allow circumferential stretching of the sock, the barrier component consisting of a liquid water impermeable, water vapour permeable membrane reinforced by a fabric support, the barrier component being corrugated or ruched in the unstretched state so that it can accomodate circumferential stretching of the inner and outer socks on stretching thereof, the barrier component being constrained against stretching in the toe-to-calf longitudinal direction by the support fabric, which does not interfere with the circumferential expansion of the ruched barrier component.

The support fabric is extensible by less than 50% in the toe-to-calf or Y-direction, but may be extensible by at least 50% in the circumferential or X-direction.

In a preferred ninth aspect of the invention a composite sock consists of an inner circular knitted sock, a bag-like barrier component consisting of a liquid water impermeable, water vapour permeable membrane reinforced by a fabric support, and an outer circular knitted sock, the outer surface of the inner sock being attached to the inner surface of the barrier component by spaced apart dots of adhesive, the outer surface of the barrier component being attached to the inner surface of the outer sock by spaced apart dots of adhesive, the membrane being attached to the support fabric by spaced apart dots of adhesive, the inner or the outer sock or both having elastomeric yarn laid-in to a number of circular courses at least in the region of the ankle, the barrier component being corrugated or ruched, when the sock is in the unstretched state, so that it can accomodate circumferential stretching of the inner and outer socks on initial stretching thereof and being circumferentially elastic so as also to be able to stretch circumferentially on further circumferential stretching of the inner and outer socks, the barrier component being constrained against stretching in the toe-to-calf longitudinal direction by the support fabric, and the laid in elastomeric yarn being such as to ensure a close fit of the sock to the foot and leg of the wearer.

In this form of the invention the inner surface of the membrane carries the dots of adhesive which preferably secure troughs of the corrugations in the corrugated barrier component to the outer surface of the inner sock, and dots of adhesive are located between the membrane and the support fabric, and the outer surface of the support fabric carries dots of adhesive which preferably secure peaks of the corrugations in the corrugated barrier component to the inner face of the outer sock.

The Sock

As indicated above the socks are preferably circular knit. They may range from fairly light fabrics e.g. of 150 g/m$^2$ to heavier socks e.g. of 300 g/m$^2$ or more such as 450 g/m$^2$. They may be plain or ribbed. They may be made of any fibre conventionally used for socks e.g. natural fibres such as wool or cotton or synthetic fibres such as polyesters or polyamides or of mixtures of natural and synthetic fibres. When ribbed the ribs typically will be aligned longitudinally.

As indicated in the preferred embodiments an elastic yarn is laid into at least some of the courses, typically in the region of the ankle. For example, an elastic yarn may be laid-in in every course around the ankle and in every other course or less frequently in regions above and below the ankle and in the foot and leg there may be regions where there are no laid-in elastic yarns.

The Membrane

The membrane is impermeable to liquid water but permeable to water vapour. Many such materials are known and are discussed in U.S. Pat. No. 5,244,716. Microporous polytetrafluoroethylene films are also known for use in socks and are described in many patents to W. L. Gore such as U.S. Pat. No. 5,529,830. Hydrophilic materials are also known which absorb moisture vapour on one face and desorb it from another depending on the concentrations of water vapour present on either side of the film. Hydrophilic polyurethanes are one such material and we have found them useful in the present invention. Examples of hydrophilic membranes are given in U.S. Pat. No. 4,613,544.

The Support Fabric

The support fabric is desirably extensible by at least 50% in the X direction but is extensible by less than 50% in the Y direction (at right angles to the X direction). The support fabric is desirably bonded to the membrane in such a way that its Y direction in the finished sock is longitudinally disposed thus constraining the membrane from stretching longitudinally of the sock and protecting it from rupturing or pinholing The elasticity of the membrane and its corrugation allow it and the barrier component to stretch in the circumferential direction. The support fabric is attached to the membrane in such a way as not to interfere with the unruching of the corrugated barrier component, and thus need not to be extensible in the X-direction either. However the support fabric is preferably stretchable in this direction also so as not to interfere with the circumferential stretching of the sock beyond that permitted by the unruching.

The support fabric is preferably knitted and may be weft inserted, monostretch warp knitted fabric, though any structure effective to give the above described stretch properties could be used.

The Adhesive

The adhesive is preferably heat activatable and details of such materials are given in U.S. Pat. No. 5,244,716. One such useful class of material is thermoplastic polyamide adhesives.

The Adhesive Distribution

The adhesive is preferably applied as dots 0.2 to 1 mm e.g. 0.5 to 0.8 mm preferably 0.55 to 0.65 mm in diameter and a density of 10 to 100 dots, preferably 15 to 75, more preferably 20 to 60 dots per square cm.

It will be appreciated that the reference to dots of adhesive includes any configuration of the deposits of adhesive that perform the function of connecting the layers together at numerous discrete spaced apart locations.

The Assembly Method

Socks in accordance with the present invention are preferably made by circular knitting the inner and outer socks to the desired size, preferably each the same size, drawing the inner sock onto an oversize bag-like first former so that the inner sock is stretched circumferentially at the foot location (C), the ankle location (B), and the leg location (A) to at least 150% of its as-knitted size, providing a bag-like barrier component of the same shape but slightly greater size than the first former, such that it can be slipped over the inner sock on the said first former, dots of activatable adhesive being applied to or having been applied to the inner sock, or the barrier component, slipping the barrier component over the inner sock and activating the adhesive to attach the inner sock to the barrier component at spaced apart locations, removing the assembly from the first former, and treating the assembly to facilitate recovery of the inner sock to its as-knitted dimensions, e.g. by wetting and drying, drawing the assembly over an oversize second former which has smaller values of (A), (B) and (C) than does the bag-like first former and which has a sock-like shape, the second former being such that the stretching of the inner sock at A, B and C is less than the stretching which occurred on the first former, dots of activatable adhesive being applied to or having been applied to the barrier component or to the outer sock, drawing the outer sock over the barrier component on the second former, and activating the adhesive to attach the barrier component to the outer sock at spaced apart locations, removing the completed sock from the second former, and treating the assembly to facilitate recovery of the socks to their as-knitted dimensions, e.g. by wetting and drying.

It will be appreciated that the dots of adhesive can be applied to the membrane at another stage in the process, for example before assembly of the bag-like barrier component or after it has been placed on the first former.

The bag-like former is preferably a flat but fat-looking "L" shape so that it is derived from a sock shape but does not have a heel as such and is much broader than a sock in the leg, heel and foot area and only has dimensions like a sock at the toe region.

The stretching of the socks caused by the first and second formers is preferably such that the ratio of the percentage increase in A for the outer sock (AO) to A for the inner sock (AI) is in the range 0.2:1 to 0.9:1, the ratio of the percentage increase in B for the outer sock (BO) to B for the inner sock (BI) is in the range 0.2:1 to 0.9:1, and the ratio of the percentage increase in C for the outer sock (CO) to C for the inner sock (CI) is in the range 0.2:1 to 0.9:1.

It will be appreciated that individual aspects of the invention such as any of the sixth to ninth aspects can be used in any desired combination e.g. the sixth and seventh, or sixth and eighth or sixth and ninth; or the seventh and eighth or seventh and ninth; or the eighth and ninth; or the sixth, seventh and eighth or the sixth, seventh and ninth or the sixth, eighth and ninth; or the seventh, eighth and ninth. Particularly advantageous structures are achieved with all four aspects used in combination. In addition each of these sixth to ninth aspects and combinations thereof can be used with one, two or three of the first, second and third aspects set out above.

The invention also extends to a simplified form of structure in which the outer sock is dispensed with. The structure has a sock on one face (the inner face), to which the membrane face of the barrier component is attached and the outer face of the support fabric provides the other face of the simplified sock (the outer face). Accordingly the membrane is protected against abrasion by being located between two fabrics. This composite sock can be used on its own but will very readily be used as an inner sock in conjunction with a conventional separate outer sock, when two pairs of socks would conventionally be worn by the user e.g. for hiking or for wet or cold conditions.

This simplified composite sock can be used either way out but is probably best used with the inner sock contacting the. wearers skin.

Such a composite sock may be made as described in the examples below except that the outer sock is omitted and the outer surface of the barrier component need not have adhesive dots applied to it.

Thus according to a first broader aspect of the present invention a composite sock consists of a first or inner stretchable fabric envelope, e.g. a sock, (which for consistency and ease of reference will be referred to as the inner fabric or sock), preferably a circular knitted sock, a bag-like barrier component which is liquid water impermeable, and water vapour permeable, and a second or outer fabric, which is preferably stretchable, preferably a knitted fabric, the first fabric being attached to one face of the barrier component, the second or outer fabric being disposed over the outer surface, preferably the entire outer surface, of the barrier component and being attached thereto, the arrangement e.g. the attachment being such as to allow circumferential stretching of the composite sock, the composite sock having elastic properties such that it can be stretched at least in the X direction to at least 50% extension, and such that, when a sample taken from the leg of the composite sock just above the ankle, the sample being 5 cm by 10 cm with the 10 cm dimension aligned in the X direction is extended on a tensometer at 100 mm per minute to 15 cms length i.e. by 50%;

(i) the load to stretch the sample in the X direction to 50% extension is less than 15N per 5 cm width;

(ii) on release of the pulling load, in such a way that the sample recovers at 100 mm/minute, the sample recovers to within 12.5% of its original 10 cms length; and (iii) when the sample is allowed to recover at 100 mm/minute (producing a hysteresis curve) the load at 25% extension during the recovery stage is at least 50% of the load at 25% extension during the stretching stage.

The barrier component is preferably a membrane, the first fabric is preferably a knitted sock e.g. a circular knitted sock, the second fabric is preferably a knitted fabric, preferably laminated to the membrane.

According to a second broader aspect of the invention, the invention also extends to a composite sock which consists of an inner circular knitted sock, a bag-like barrier component which is liquid water impermeable, and water vapour permeable, and a second or outer knitted fabric, the-inner sock being attached to the barrier component, the second or outer fabric being disposed over the surface of the barrier component, preferably the entire outer surface of the barrier component, and being attached thereto, the attachment being such as to allow circumferential stretching of the sock, preferably at least in the X direction to at least 50% extension, the inner sock having elastic yarns laid-in in X direction courses, i.e. circumferentially of the composite sock so that the ability of the composite sock when stretched laterally to recover to, or towards, its original unstretched shape and dimensions is enhanced.

According to a third broader aspect of the invention, the invention also extends to a composite sock which consists of an inner stretchable fabric envelope e.g. a sock, most preferably a circular knitted sock, a bag-like barrier component which is liquid water impermeable, and water vapour permeable, the inner sock being attached to the barrier component, the arrangement, e.g. the attachment, being such as to allow circumferential stretching of the sock, preferably at least in the X direction to at least 50% extension, the barrier component consisting of a liquid water impermeable, water vapour permeable membrane reinforced by a fabric support, which constitutes the second or outer fabric, the barrier component being corrugated or ruched in the unstretched state so that it can accomodate circumferential stretching of the inner sock on stretching thereof, the barrier component being constrained against stretching in the toe-to-calf longitudinal direction by the support fabric, which does not interfere with the circumferential expansion of the ruched barrier component.

Preferably the support fabric is extensible by less than 50% in the toe-to-calf or Y-direction, but may be extensible by at least 50% in the circumferential or X-direction.

According to a fourth broader aspect of the invention, the invention also extends to a composite sock which consists of an inner circular knitted sock, and a bag-like barrier component consisting of a liquid water impermeable, water vapour permeable membrane reinforced by a fabric support, which constitutes the second or outer fabric, the outer surface of the inner sock being attached to the inner surface of the barrier component by spaced apart dots of adhesive, the membrane being attached to the support fabric by spaced apart dots of adhesive, the inner sock having elastomeric yarn laid-in to a number of circular courses at least in the region of the ankle, the barrier component being corrugated or ruched, when the sock is in the unstretched state, so that it can accomodate circumferential stretching of the inner sock on initial stretching thereof and being circumferentially elastic so as also to be able to stretch circumferentially on further circumferential stretching of the inner sock, preferably at least in the X direction to at least 50% extension, the barrier component being constrained against stretching in the toe-to-calf longitudinal direction by the support fabric, and the laid-in elastomeric yarn ensuring a close fit of the sock to the foot and leg of the wearer.

According to a fifth broader aspect of the invention, the invention also extends to a method of making a composite sock which comprises circular knitting an inner sock to the desired size, drawing the inner sock onto an oversize bag-like former (which will be called the first former for consistency and ease of reference),so that the inner sock is stretched circumferentially at the foot location, (C), the ankle location (B), and the leg location (A) to at least 150% of its as-knitted size, providing a bag-like barrier component, which is liquid water impermeable, and water vapour permeable, the barrier component being of the same shape but slightly greater size than the first former, such that it can be slipped over the inner sock on the said first former, dots of activatable adhesive being applied to or having been applied to the inner sock, or the barrier component, slipping the barrier component over the inner sock and activating the adhesive to attach the inner sock to the barrier component at spaced apart locations, removing the assembly from the first former, and treating the assembly to facilitate recovery of the inner sock to its as-knitted dimensions, e.g. by wetting and drying.

The invention also extends to a method of making a composite sock which comprises circular knitting inner and outer socks to the desired size, preferably each the same size, drawing the inner sock onto an oversize bag-like first former so that the inner sock is stretched circumferentially at the foot location (C), the ankle location (B), and the leg location (A) to at least 150% of its as-knitted size, providing a bag-like barrier component, which is liquid water impermeable, and water vapour permeable, the barrier component being of the same shape but slightly greater size than the first former, such that it can be slipped over the inner sock on the said first former, dots of activatable adhesive being applied to or having been applied to the inner sock, or the barrier component, slipping the barrier component over the inner sock and activating the adhesive to attach the inner sock to the barrier component at spaced apart locations, removing the assembly from the first former, and treating the assembly to facilitate recovery of the inner sock to its as-knitted dimensions, e.g. by wetting and drying, drawing the assembly over an oversize second former which has smaller values of (A), (B) and (C) than does the bag-like first former and which has a sock-like shape, the second former being such that the stretching of the inner sock at A, B and C is less than the stretching which occurred on the first former, dots of activatable adhesive being applied to or having been applied to the barrier component or to the outer sock, drawing the outer sock over the barrier component on the second former, and activating the adhesive to attach the barrier component to the outer sock at spaced apart locations, removing the completed sock from the second former, and treating the assembly to facilitate recovery of the socks to their as-knitted dimensions, e.g. by wetting and drying.

The invention can be put into practice in various ways and a number of specific embodiments will be described by way of example with reference to the accompanying drawings and specific examples.

SPECIFIC DESCRIPTION

Figure 3A:
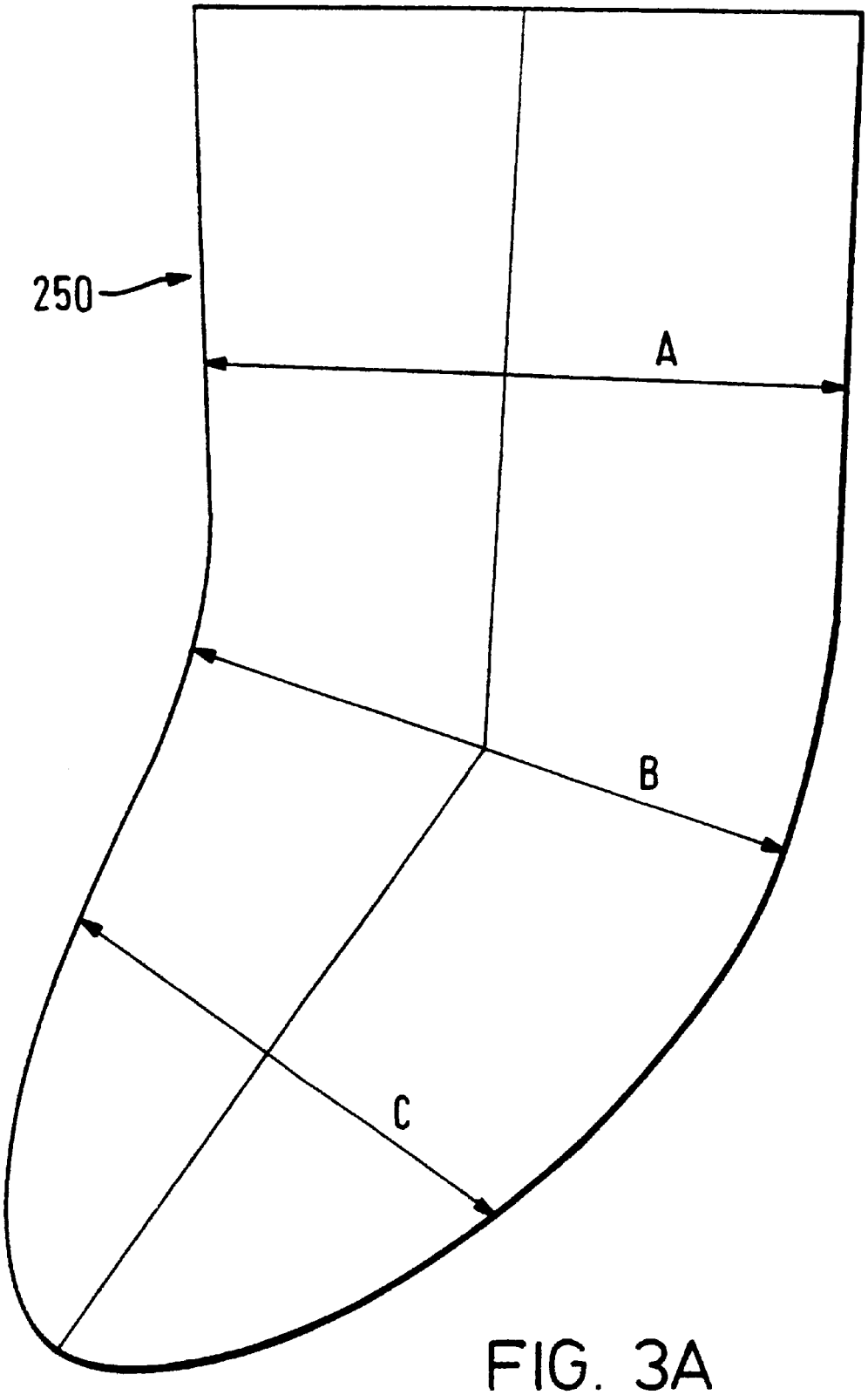
FIGS. 3A and 3B are plan views on the same scale as FIGS. 2A to 2C of two formers which are used in the production of a composite sock in accordance with the present invention.
Figure 3B:
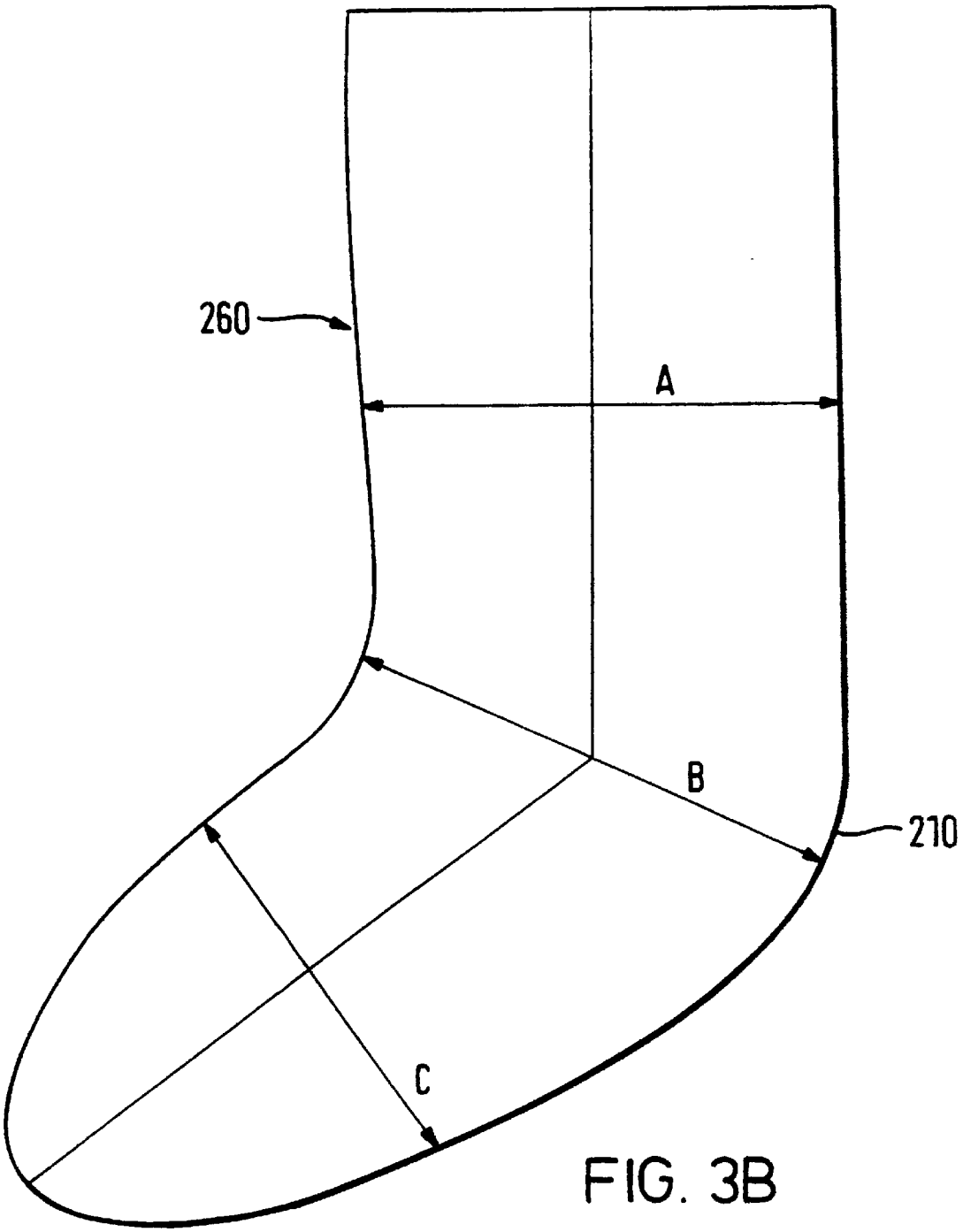
Figure 6A:
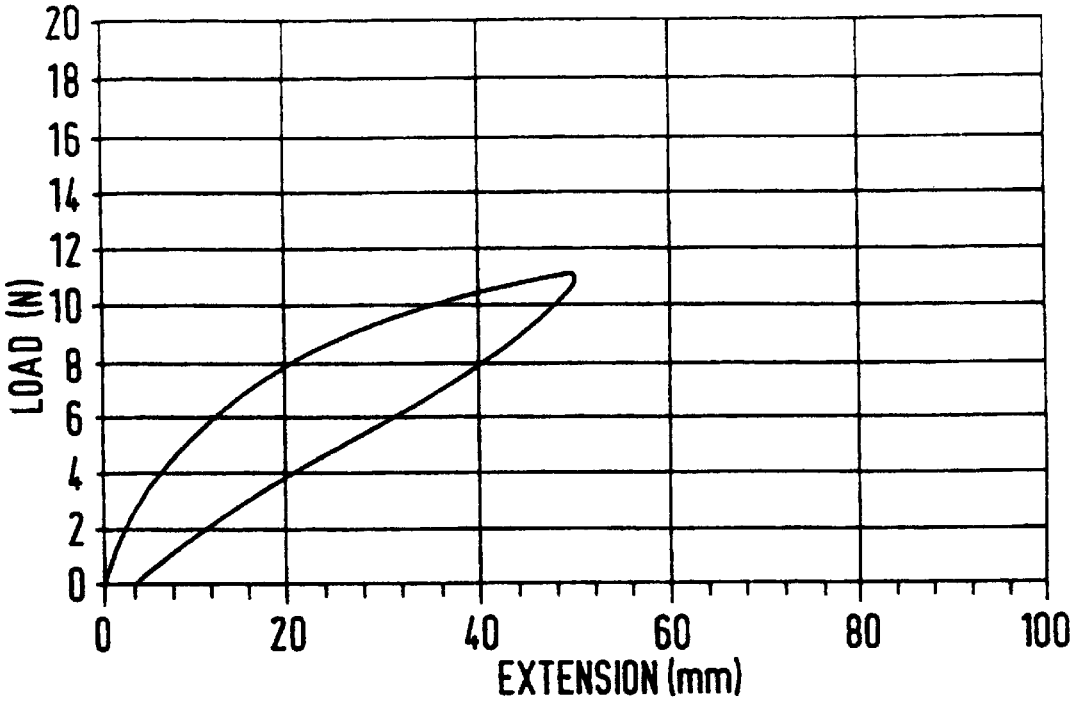
Figure 6B:
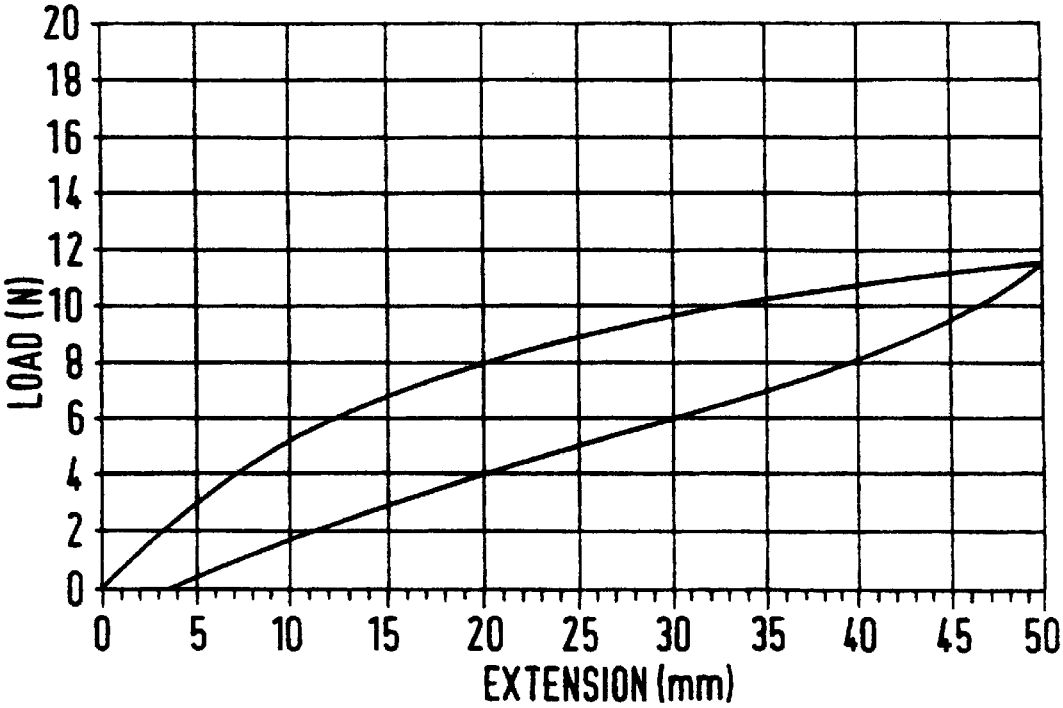
Figure 6C:
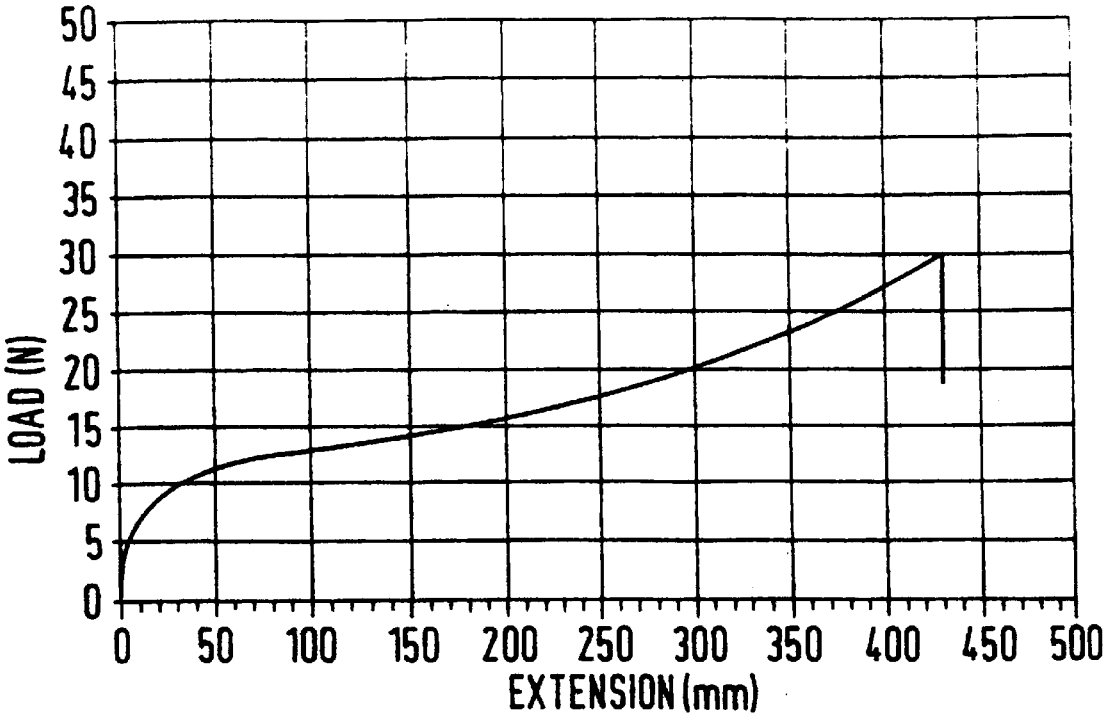
Figure 6D:
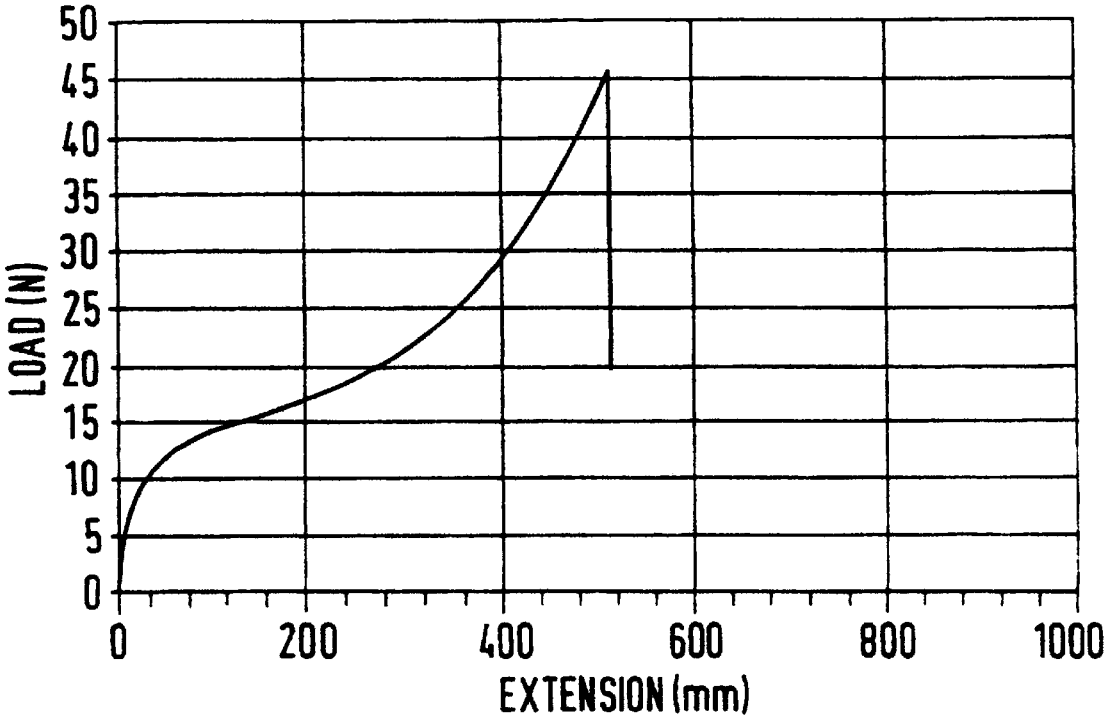
Figure 7A:
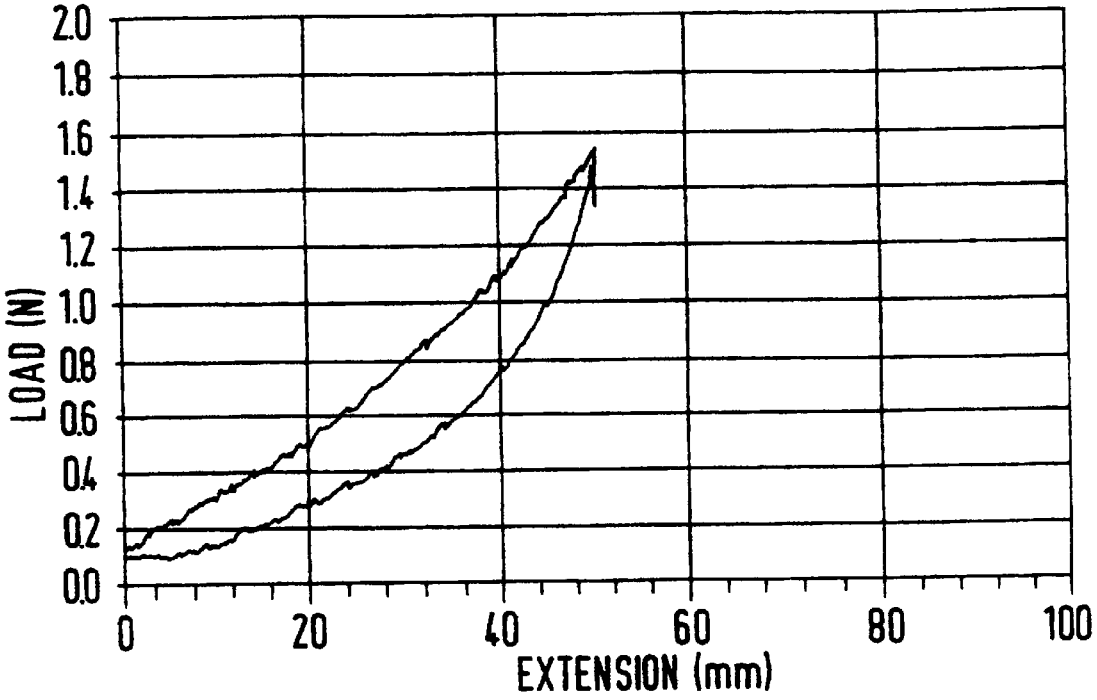
Figure 7C:
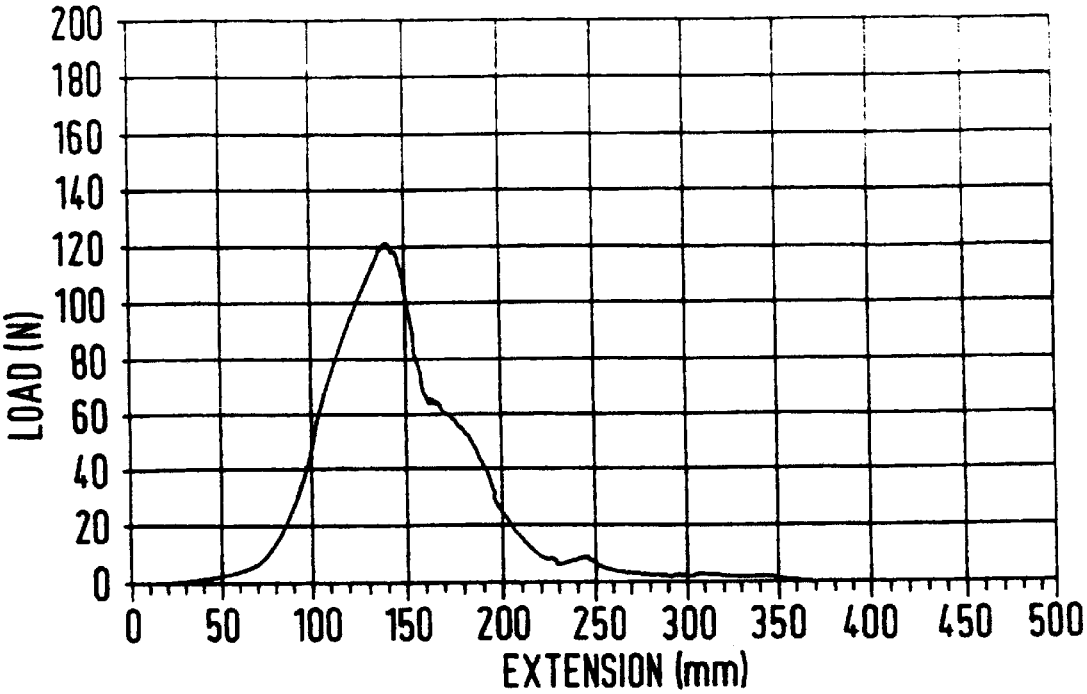
Figure 7D:
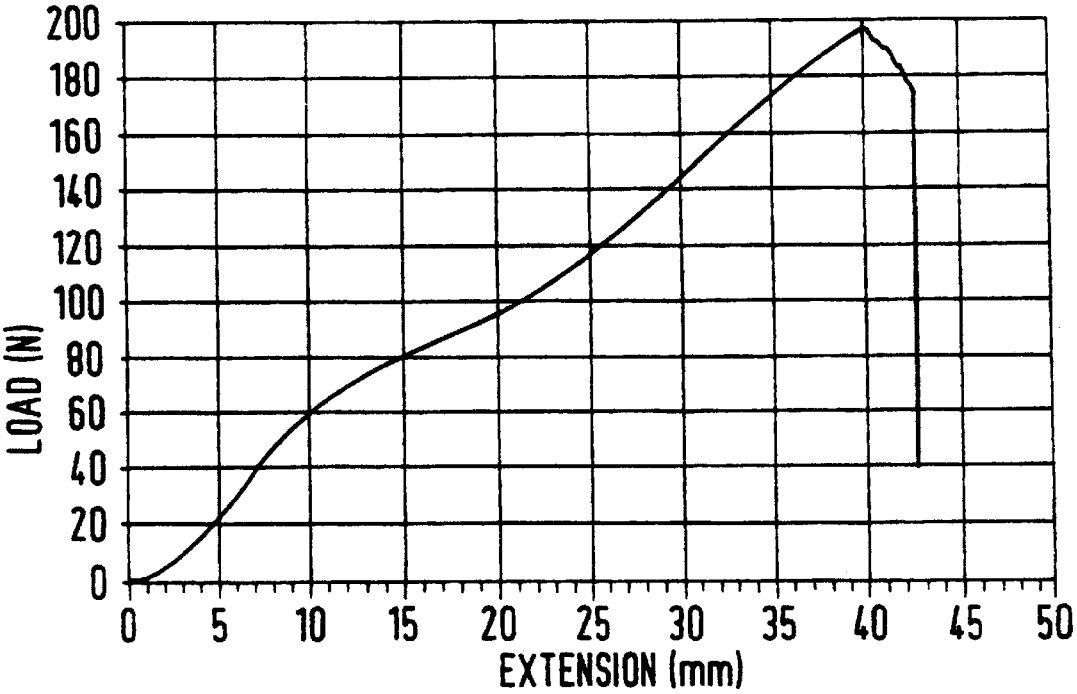
Figure 8A:
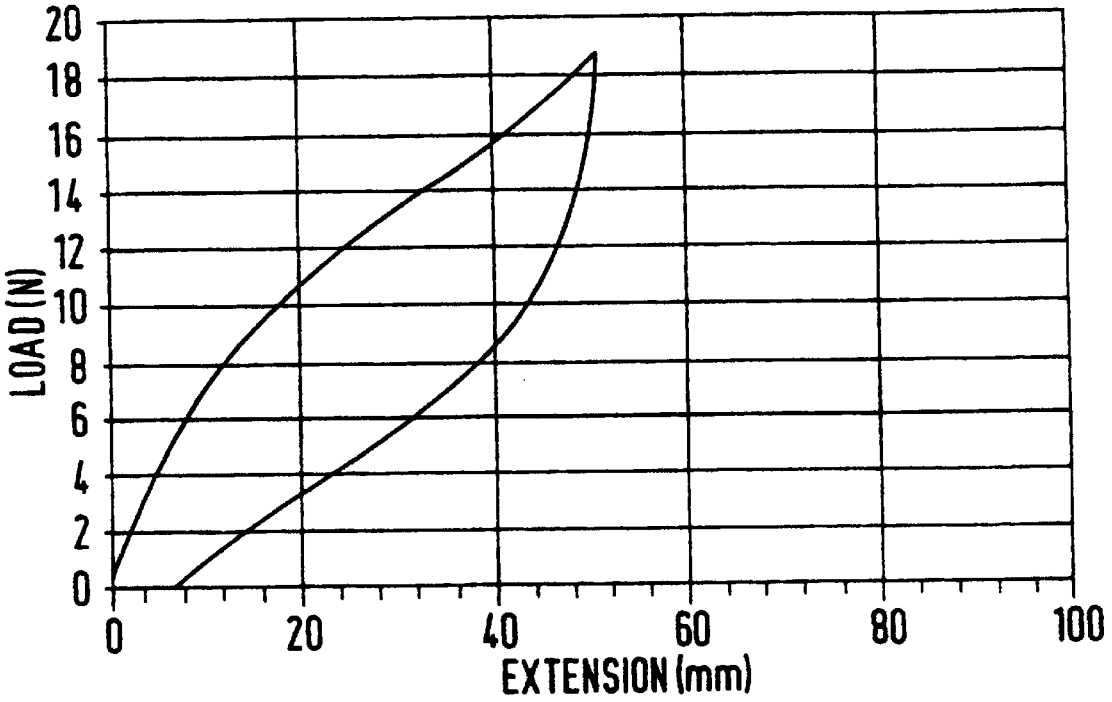
Figure 8C:
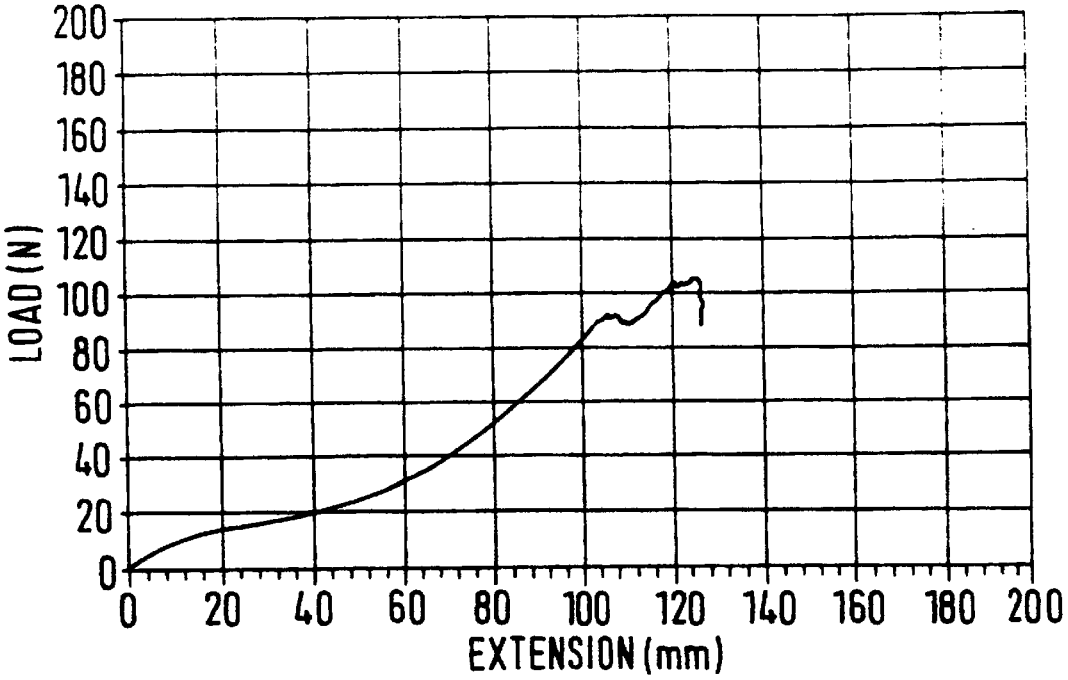
Figure 8D:
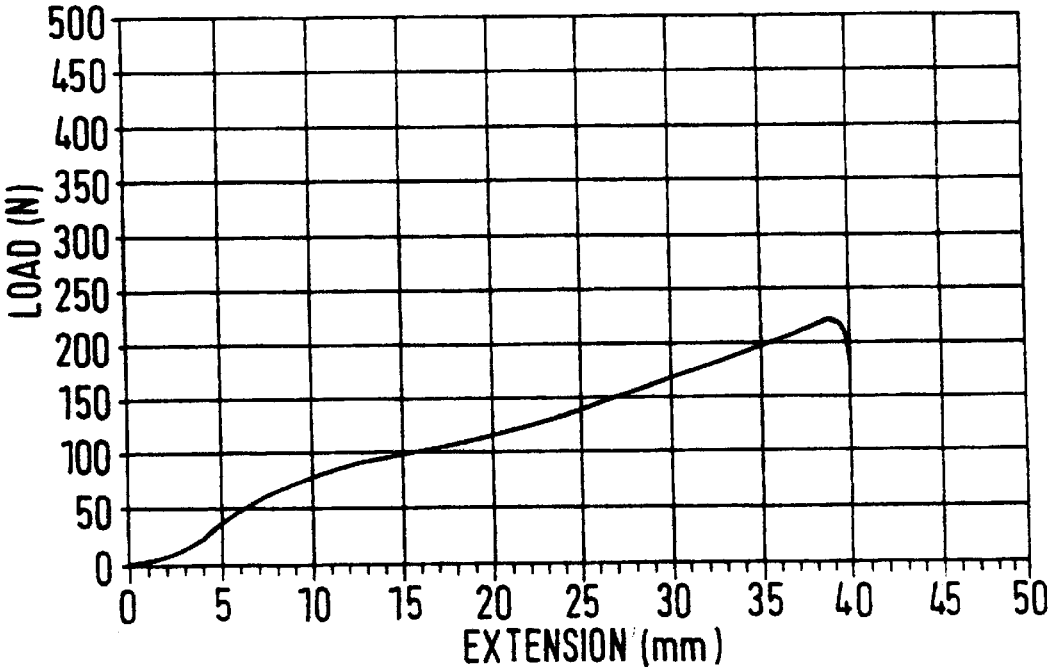
Figure 9A:
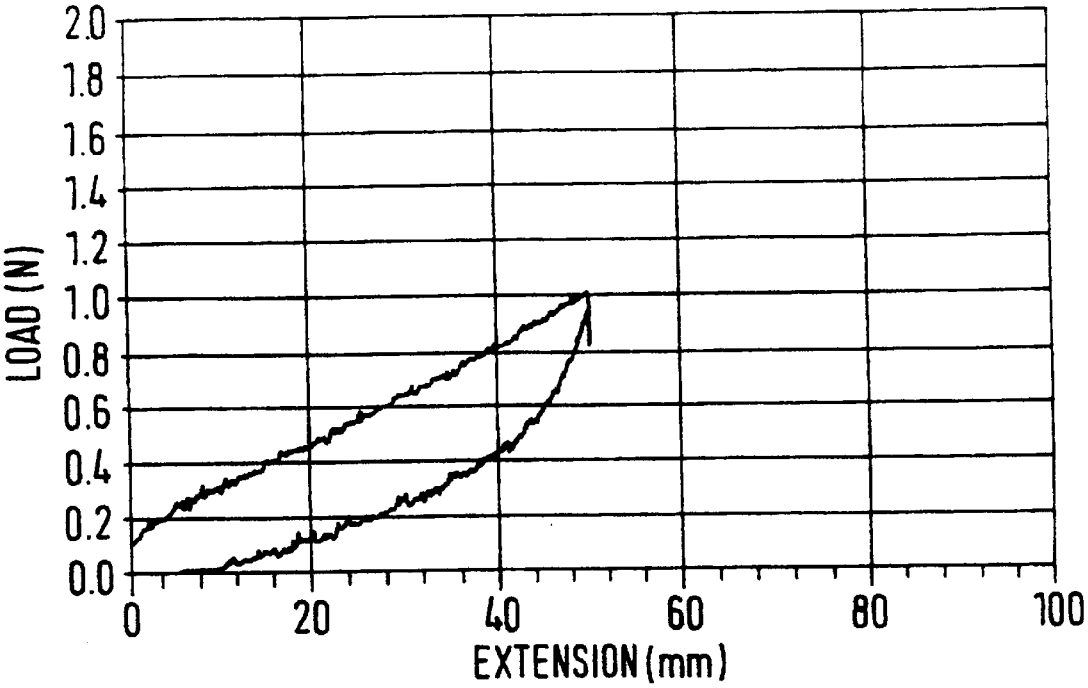
Figure 9B:
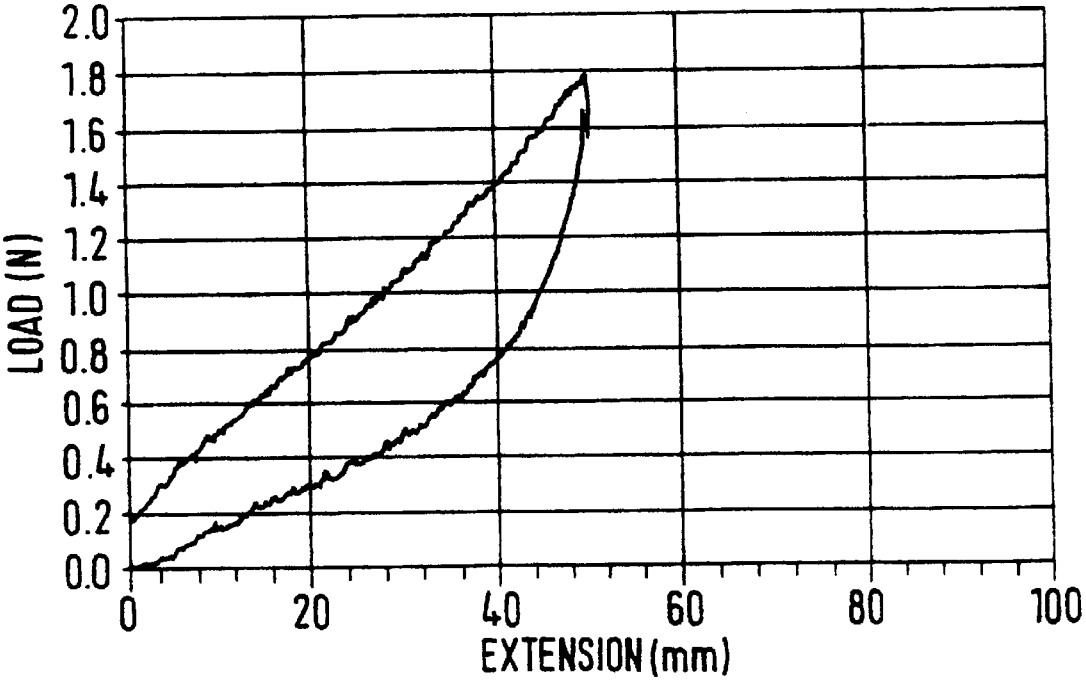
Figure 10A:
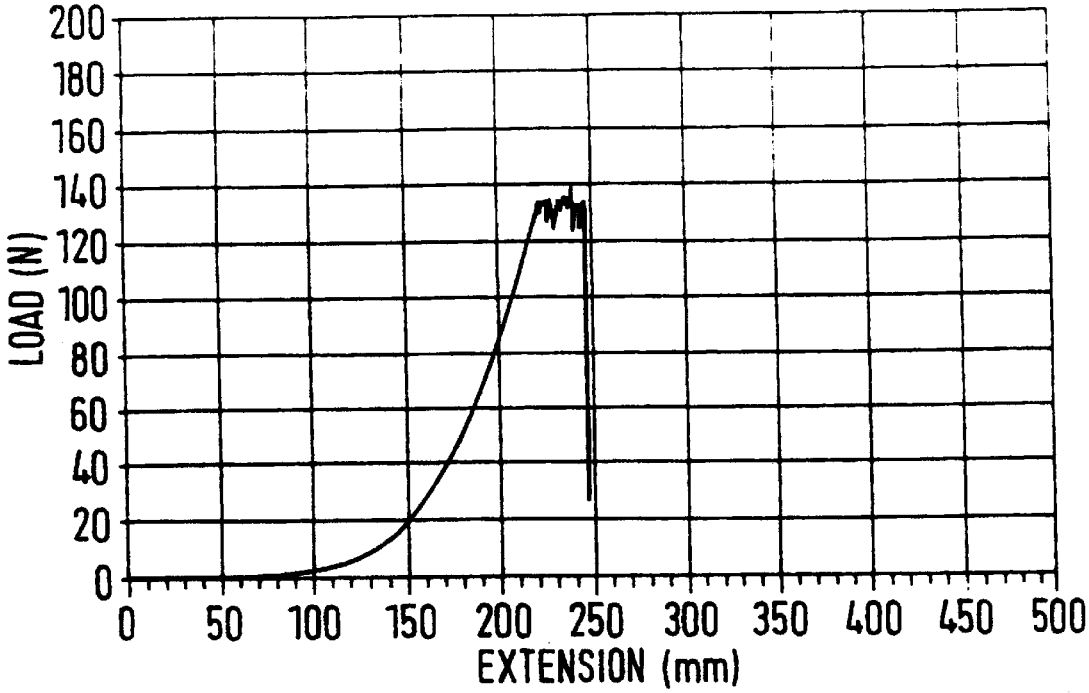
Figure 10B:
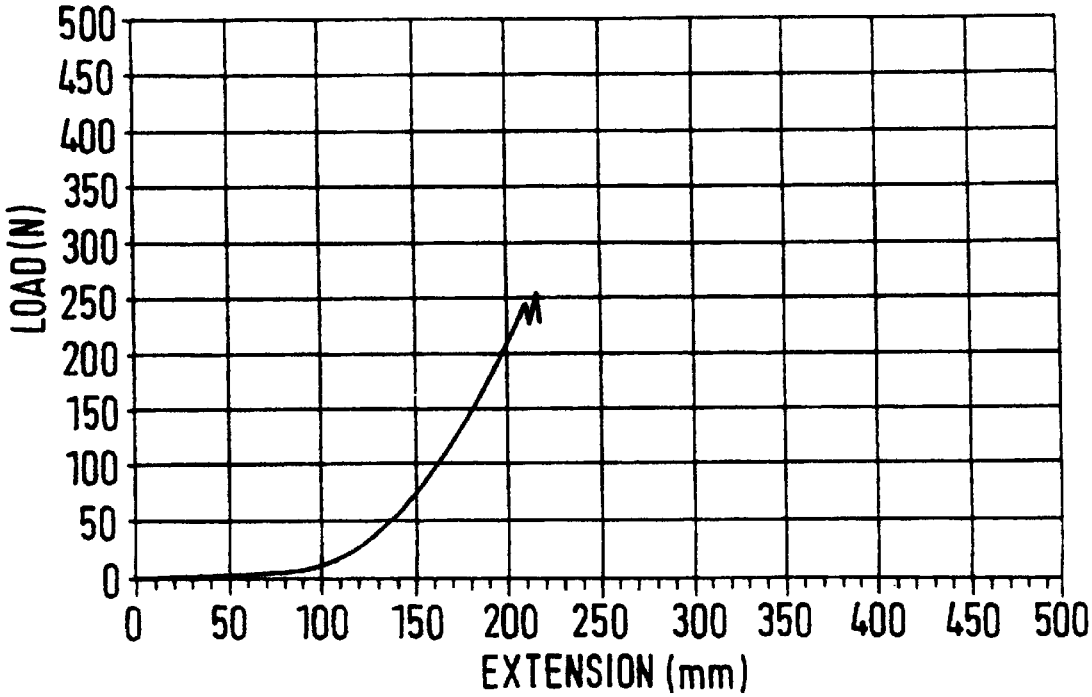

FIG. 3A is of the former over which the inner sock is stretched, the barrier component positioned in unstretched condition and the two adhered together by dots of adhesive; and FIG. 3B is of the former over which the laminate of the inner sock and the barrier component is stretched and over which the outer sock is then stretched and the outer face of the barrier component adhered to the inner face of the outer sock by dots of adhesive;

FIGS. 4 to 11 are all for the materials of Example 1;

FIGS. 4A to 4D are hysteresis curves for the inner sock;

FIGS. 5A to 5D are extension to break curves for the inner sock;

FIGS. 6A and 6B are hysteresis curves for the membrane used in the barrier component;

FIGS. 6C and 6D are extension to break curves for the membrane;

FIG. 7A is a hysteresis curve for the support fabric used in the barrier component in the X direction (there is no curve (FIG. 7B) for the Y direction);

FIGS. 7C and 7D are extension to break curves for the fabric support;

FIG. 8A is a hysteresis curve for the barrier component in the X direction, (there is no curve (FIG. 8B) for the Y direction);

FIGS. 8C and 8D are extension to break curves for the barrier component;

FIGS. 9A and 9B are hysteresis curves for the outer sock;

FIGS. 10A and 10B are extension to break curves for the outer sock;

FIGS. 11A to 11D are hysteresis curves for the complete sock;

FIGS. 11E to 11H are extension to break curves for the complete sock.

Figure 12:
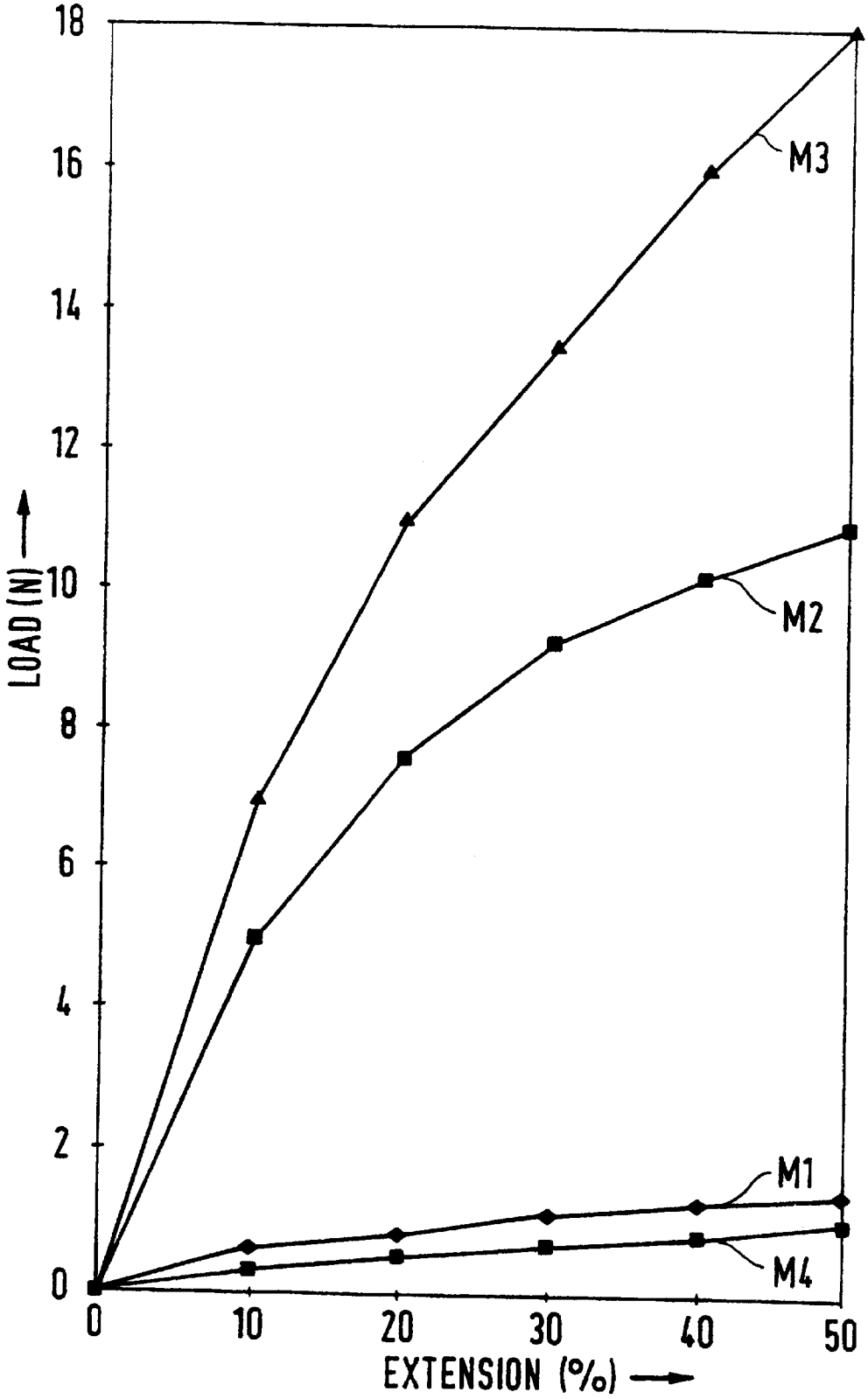

FIG. 12 is a graph of moduli for the inner sock (curve M1), the membrane (curve M2), the barrier component (curve M3) and the outer sock (curve M4).

All hydrostatic head values herein are measured on a Shirley Hydrostatic Head Tester in accordance with BS3424 Part 26: 1990: Method 29A; Determination of Resistance to Water Penetration and Surface Wetting.

The hysteresis curves shown herein are generated as follows.

Each sample used is 5 cm wide and 10 cm long. The sample is clamped in the jaws of a Testometric TM tensometer. It is extended in the 10 cm direction at a rate of 10 mm/min to 50% extension, i.e. until it is 15 cm in length. It is then allowed to relax at 100 mm/min. The load in Newtons is plotted against the extension in mm, during both the extension and recovery parts of the cycle.

It takes more force to extend the sample than to recover it, and so the upper curve represents extension and the lower curve represents recovery.

Extension to break tests were done on a Testometric TM tensometer, with samples 5 cm wide×10 cm long extended in the 10 cm direction at a rate of 100 mm/min. In this test instead of extending to the 50% extension and allowing the sample to recover, it was extended until it broke. This gives values for tensile strength (load at break point) and elongation at break.

The sock or stocking may be characterised by three transverse dimensions which will be referred to as A, B and C. These are measured on the sock when it is arranged flat and unstretched and folded about its front and rear lines. They will be described with reference to the inner sock shown in FIG. 2A which is shown arranged flat and folded about its front and rear lines. The longest transverse dimension we call B and this is the shortest distance from the point 40 of the heel 75 to the front 41 of the ankle 42; this is the largest transverse dimension to which the leg portion of a sock has to stretch as it is drawn onto the foot.

The second dimension C is the transverse dimension halfway along the foot 46 from the mid point MH of the heel/ankle line 40–41 to the toe 43. We define C as being the length of the perpendicular 45 at the mid point MC of the line from the mid point MH of the heel-to-ankle line to the toe 43. The length B is the sum of lb1 and lb2 which we have defined as being equal. The length C is the sum of lc1 and lc2 which may or may not be equal. The distance from MH to MC is lf.

A is the transverse dimension across the leg portion 47 of the sock taken the same distance lf up the leg from the midpoint MH of the heel to front of ankle line B as C is taken down the foot.

The line about which A is taken is the line from MH to the midpoint MO of the line across the opening 48 or top of the sock. A is the perpendicular to the line MH-MO. If the opening or top is closer to MH than the distance lf then A is taken at the place nearest the opening which allows A to extend from side to side of the sock. The dimension A defines the closeness of fit of the sock around the leg above the ankle and a close fit here is important to hinder water running down the leg and into the interior of the sock and provides advantages in terms of comfort and avoidance of lateral creasing.

The dimensions C and particularly B determine the closeness of fit around the foot and in the heel to front-of-ankle area. The dimension B to a large extent and in conjunction with A defines the ease with which or indeed whether the sock can be drawn onto the foot. Thus there is a conflict inherent in a foot covering made of a material of low extensibility or of high resistance to initial stretch (initial modulus) between the closeness of fit which can be obtained and the need to provide a shape with sufficient space to allow the foot to be placed inside the covering.

In a man's fashioned sock the ratio of A to B to C is typically 0.7:1:0.8. However sports socks are made which are tubular and there the ratio is 1:1:1.

Thus more broadly the invention is concerned with socks in which the ratio of A to B and of C to B is in the range 0.5:1 to 1:1.

Structures in which the ratio of A to B is greater than 1:1 are liable to require too much stretching at the ankle region; thus either the leg portion of the sock fails to fit closely or if a close fit is achieved there, it will be very difficult to draw the sock on to the foot and if this can be done the ankle will be liable to be excessively restricted and discomfort produced.

The locations of the lines A, B and C on the first and second formers, the barrier component and the outer sock are determined as follows.

Figure 2A:
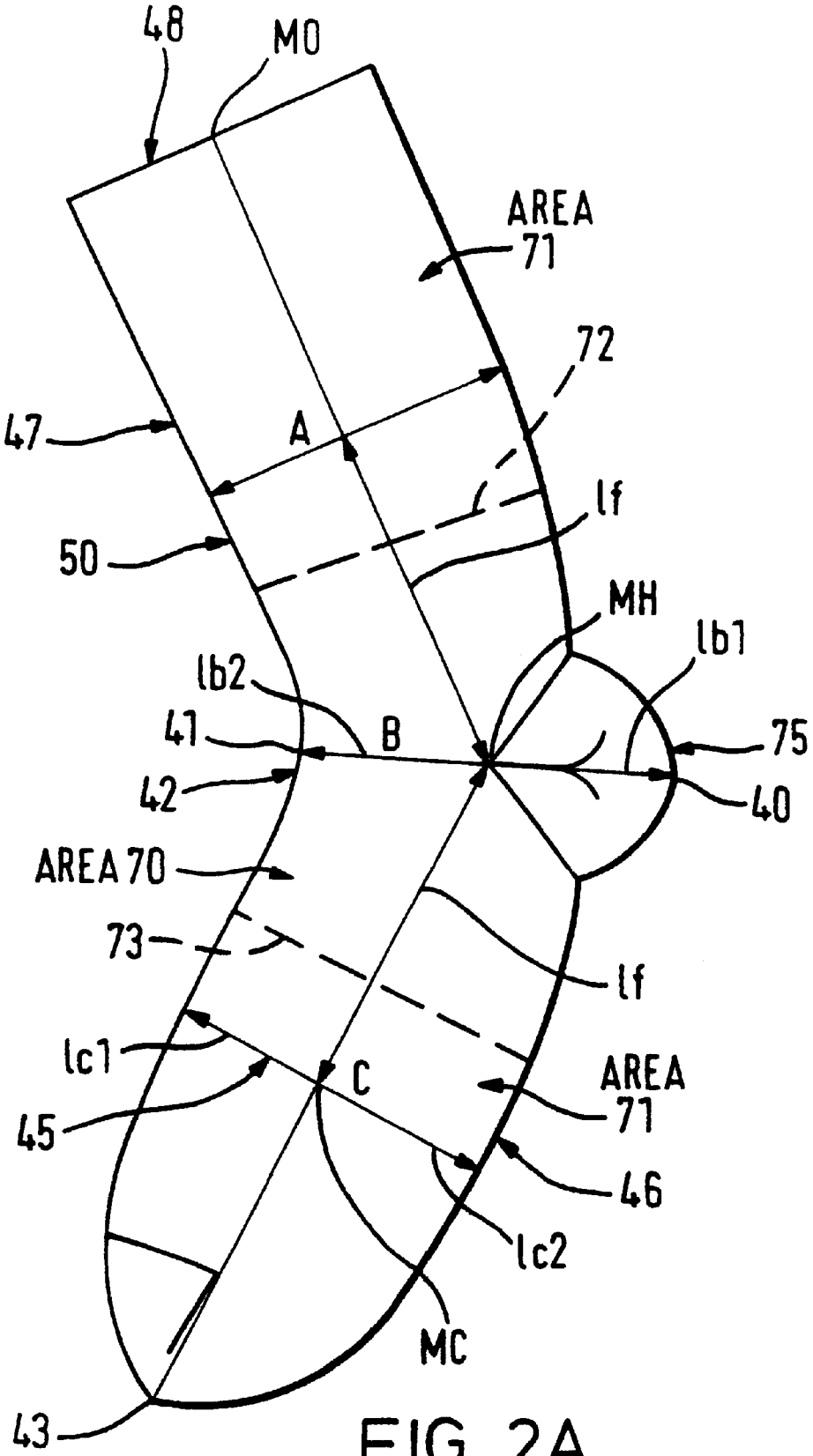
FIGS. 2A, 2B and 2C are plan views of components of a composite sock in accordance with the present invention, namely the inner sock, the barrier component and the outer sock respectively all on the same reduced scale (about 50%) and all of a size appropriate for an average UK mens size 7–9 sock.

The lines A, B and C are drawn onto the inner sock when it is in its flat unstretched state as shown in FIG. 2A. The inner sock is then drawn onto the first former, see FIG. 3A, and is stretched evenly thereover. (As mentioned above the first former is bag-like and a flat but fat looking "L" shape that is derived from a sock shape but does not have a heel as such). The locations of the lines A, B and C on the stretched inner sock are then marked onto the first former and are shown in FIG. 3A.

The barrier component (FIG. 2B) is then slipped over the first former (FIG. 3A) and the lines A, B and C marked on the barrier component by reference to the lines A, B and C marked on the first former.

The inner sock is also drawn over the second former (FIG. 3B) (which is narrower than the first former) and stretched evenly thereover. The locations of the lines A, B and C on the stretched inner sock are then marked onto the second former and are shown in FIG. 3B.

The lines A, B and C can be located on the outer sock (as for the inner sock) when in its flat unstretched state by reference to the point of the heel and the line from the point of the heel 40 to the front of ankle line i.e. from the point 40 of the heel 75 to the point 41 of the front of the ankle 42. A, B and C for the outer sock are shown in FIG. 2C. As can be seen by a comparison of FIGS. 3A and 3B the inner sock is stretched more than the outer sock. This is discussed in more detail below with reference to Table 11.

EXAMPLE 1

Figure 1:
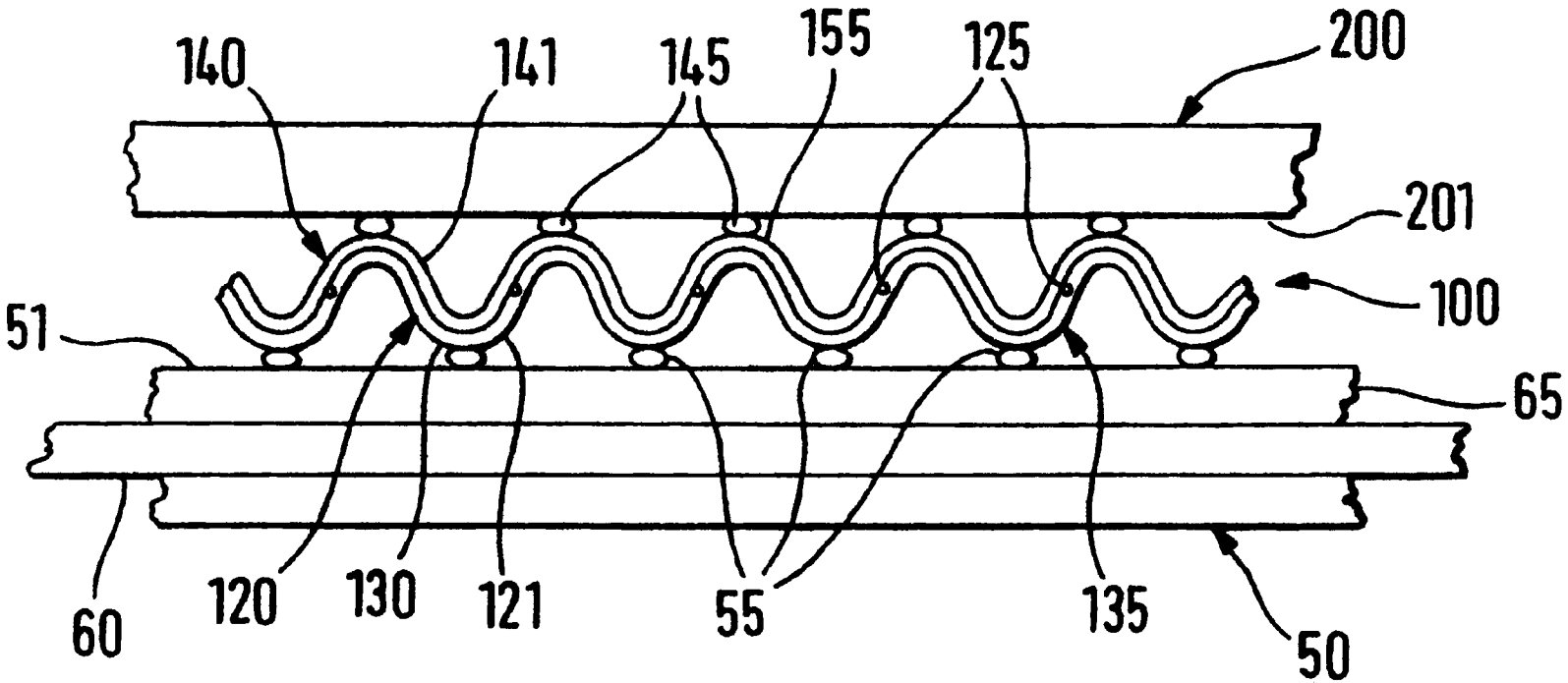
FIG. 1 is a diagrammatic cross sectional view along the X direction, i.e. looking in the Y direction and shows a composite material in accordance with the present invention in the unstretched state.

A sock or stocking in accordance with the present invention consists of an inner knitted sock 50, a bag-like barrier component 100 consisting of a liquid water impermeable, water vapour permeable membrane 120 reinforced by a fabric support 140 and an outer knitted sock 200 as shown diagrammatically in FIG. 1.

The outer surface 51 of the inner sock 50 is attached to the inner surface 121 (provided by the membrane 120) of the barrier component 100 by spaced apart dots of adhesive 55. The outer surface 141 (provided by the support fabric 140) of the barrier component 100 is attached to the inner surface 201 of the outer sock 200 also by spaced apart dots of adhesive 145.

The membrane 120 is also attached to the support fabric 140 by spaced apart dots of adhesive 125.

In FIG. 1 the inner sock is represented by the layer 50 with one laid in yarn 60 in front of a course 65.

The inner surface of the membrane 120 carries dots of adhesive 55 which secure troughs 130 of the corrugations 135 to the outer surface 51 of the inner sock 50.

Dots of adhesive 125 are also located between the membrane 120 (shown as a layer) and the support fabric 140 (also shown as a layer).

The outer surface 141 of the support fabric 140 also carries dots of adhesive 145 which secure peaks 155 of the corrugations 135 to the inner face 201 of the outer sock 200.

The frequency of the dots 55, 125 and 145 shown in FIG. 1 is purely diagrammatic, specific details are given later.

Figure 2B:
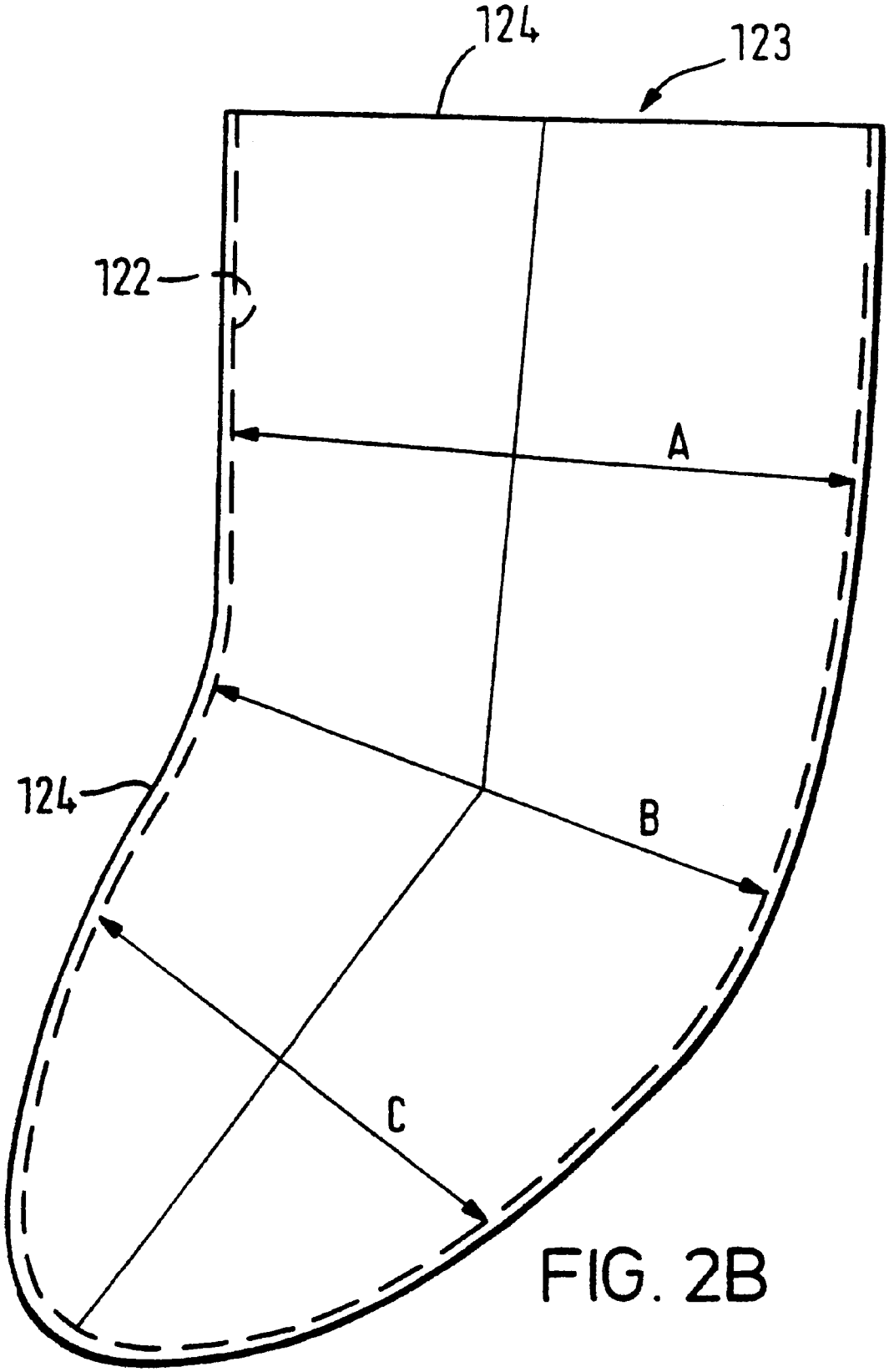
Figure 2C:
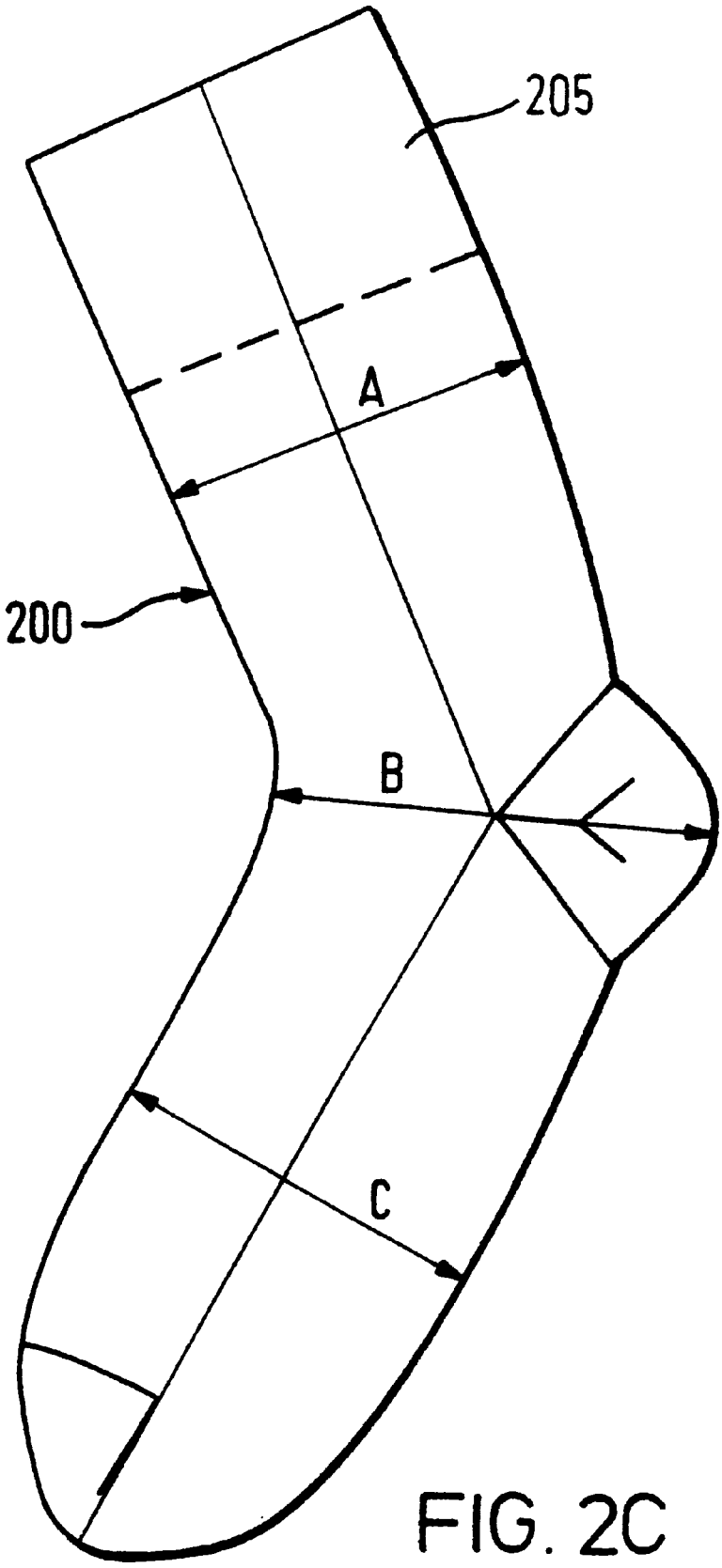

The membrane is laminated to the support fabric to produce a composite and cut along the line 124 (see FIG. 2B).

The barrier component is formed of two sheets of the composite placed membrane to membrane face to face (see FIG. 2B) and welded around their edges along the dotted line 122 to form a sock like shape leaving an opening 123 through which the foot can be inserted. The barrier component is bag-like and oversized compared to the inner sock and the intended final sock. Ultrasonic RF welding is effective.

The inner sock So has elastic yarns 60 laid-in in the X direction courses 65, i.e. circumferentially of the sock so that the ability of the sock when stretched laterally to recover to, or towards, its original unstretched shape and dimensions is enhanced. FIG. 2A is a plan view. Ribs (not shown) extend perpendicular to the courses 65.

In the specific preferred embodiment of Example 1 the elastic yarn properties and frequency of occurrence, i.e. every course or every other course or less frequently, are such that the inner sock can be stretched at least in the X direction by 50% extension by a load of less than 5N per 5 cm width, e.g. 0.1 to 4, preferably 0.2 to 3.5 or more preferably 0.5 to 2.5N per 5 cm width when a sample taken from the leg of the sock just above the ankle, the sample being 5 cm by 10 cm with the 10 cm dimension aligned in the X direction is extended at 100 mm per minute on a tensometer to 15 cms length.

The sample is cut from the sock so that the sample has a homogeneous structure i.e. it is cut from a region just clear of the heel 75 and within the area 70; since it is 10 cms in length it will include the seam of the membrane bag at one end. It will be appreciated that the tensile testing and indeed the hydrostatic head and watervapour permeability tests are such that portions have to be cut out from the sock which is thus destroyed. Accordingly the properties quoted are those obtained from a number of socks all made to the same specification.

Also the inner sock is such that on release of the pulling load in such a way that the sample recovers at 100 mm/minute the sample recovers to within 5% e.g. 1 to 5% of its original 10 cms length. (The extent of recovery after extension by 50% in the Tables of data herein is expressed as the % of the original sample length to within which the samples under test recover. This is called the recovery % herein).

Also the inner sock is such that when the X direction sample is stretched by 50% at 100 mm/minute and then allowed to recover at 100 mm/minute (producing a hysteresis curve) the load at 25% extension during the recovery stage is at least 60%, e.g. 60% to 80% of the load at 25% extension during the stretching stage. (The ratio of these load values is referred to as the power rating herein).

These properties of the inner sock ensure that the barrier component does not stay extended after being drawn on to the foot and that the complete sock recovers to provide a close fit in wear on the foot.

The fabric support is extensible by at least 50% in the X direction but is extensible by less than 50% in the Y direction (which is at right angles to the X direction) and which is the long or toe-to-calf direction in the sock. The membrane is liable, if stretched too much, to rupture, and the fabric support constrains the membrane from stretching too much in the Y direction. The Y direction is the direction in which the sock is stretched the most during donning and where rupturing of the membrane is most likely to occur. The barrier component is provided with the ability to stretch in the X direction by being provided with ruching or corrugation or puckering such that it can extend adequately in the X direction without actually stretching the material of the membrane itself. This provision however leaves no force by which the barrier component can return by itself to its original shape and size. In addition the fabric support and the adhesives are liable to introduce a degree of resistance to the return of the barrier component to its original shape and size.

As indicated above the circumferential elastic recovery properties of the inner sock ensure that the complete sock can and does return to its original shape and size on being put on the foot and gives a close fit.

This puckering of the barrier component is achieved by placing the inner sock on a first former 250 (see FIG. 3A) which is the same bag-like shape as the shape defined by the weld line 122 and the opening 123 (see FIG. 2B) but slightly smaller and thus is of a size such that the inner sock (FIG. 2A) has to stretch laterally to at least 150% both in the region below the ankle namely along the line C (in FIG. 2A) and in the leg region above the ankle namely along the line A (in FIG. 2A) as well as stretching at least this amount at the ankle, namely along the line B (in FIG. 2A).

The oversize bag-like barrier component 10 (see FIG. 2B) which is slightly larger than the former 250 (just enough to enable it to be slipped on over the inner sock on the former 250 without stretching) (and which carries dots of heat activatable adhesive on its inner surface) is slipped on over the inner sock on the former 250. The adhesive dots are activated and secure the flat unstretched barrier component to the stretched inner sock. The composite is removed from the former, wetted and dried to assist recovery of the inner sock. It recovers or shrinks back in the X direction and induces ruching in the barrier component.

In the initial production of the barrier component the outer surface thereof (the support fabric) also had S heat activatable adhesive dots formed on it. The recovered inner sock carrying the ruched barrier component is now mounted on a second former 260 (see FIG. 3B) which is narrower than the former 250 but wider than the intended eventual size of the sock. The outer sock (see FIG. 2C) is stretched over the array and aligned over the inner sock and barrier component heel to heel and the adhesive dots activated. The sock is then removed from the former 260 and wetted and dried so that the sock recovers to its final size due to the elastication.

This elastication comes predominantly from the inner sock.

Thus in the finished sock the inner sock in the relaxed state is essentially neither compressed nor stretched, though there will be some stretching in the vicinity of the dots of adhesive and some compression in the regions between dots of adhesive, the barrier component is ruched or corrugated, the corrugations extending generally along the length of the sock so that on radial stretching of the sock the barrier component can extend circumferentially without requiring any actual stretching of the membrane. In the relaxed state the outer sock also is essentially neither compressed nor stretched in a radial direction, though there will again be some stretching in the vicinity of the dots of adhesive and some compression in the regions between the dots of adhesive, such stretching and compression not being such that the outer sock appears wrinkled or visually unacceptable. Such localised compression will be greater in the inner sock than in the outer sock because it has been subjected to more stretching in the assembly process.

The inner sock is preferably ribbed with the ribs extending along the length of the sock.

The detailed structure of the components described above will now be given.

Inner Sock 50

The preferred inner sock (see FIG. 2A) is a knitted sock of mock 1×1 rib sandwich terry construction, knitted on a 168 needle circular knitting machine with a 10.16 cm (4 inch) cylinder diameter.

The leg and foot region will be described first then the heel and toe.

Leg and Foot

The fibre composition is 25 tex cotton backing yarn with 14 tex Tactel (Trade Mark) (microfibre nylon) used for the terry loop and on the face. The laid-in yarn is 0.254 mm diameter rubber core covered with two 13 tex 20 filament textured nylon 66 yarns. The laid-in yarn is laid into the knitted structure every other course (area 71), and laid in every course in two 7 cm wide bands above and below the heel (area 70). The areas 71 and 70 meet at the lines 72 and 73 (see FIG. 2A). (This differential elastication assists in the fit of the final sock.) If desired the lines 72 and 73 can be moved so that the band in the leg above the line B extends further up the sock for example 12 cms e.g. to or beyond the line A. The band in the foot may extend down the foot a lesser distance e.g. 5 cms.

Accordingly in this preferred embodiment the elastic yarn is laid-in throughout the sock, in every course in the area or region 70 and in every other course in the areas or regions 71.

Such laying-in ensures that the sock is a close fit in all regions.

The ratio of the axial length (along the line lf) of the region in which there is laying-in in every course above the ankle to the axial length of such laying-in below the ankle in this embodiment thus may range from 1:1 to 12:5, i.e. from 1:1 to 2.4:1.

The rubber content of the rubber/nylon laid-in yarn is 40% by weight. In the area 70 the inner sock contains 30% by weight of the rubber/nylon yarn and the rubber content of this area is accordingly 12% by weight. In the area 71 the inner sock contains 20% by weight of the rubber/nylon yarn and the rubber content of this area is accordingly 8% by weight.

A laid in yarn is a non-knitted thread which is incorporated into the fabric during the same knitting cycle as the ground structure of knitted threads which hold it in position. Laid in yarns are therefore oriented in the X direction when knitting on a circular machine as in this case.

A single strand of the laid-in rubber/nylon yarn was tested on the tensometer as described above. The Load at 50% extension was 0.16N and recovery was complete, i.e. recovery % is 0 and the Power Rating was high (in excess of 90%). The Load at break was 5.3N and the Extension at break was 555%.

The socks are knitted to a finished width of 9.5 cms leg and foot diameter, measured along lines A and C on FIG. 2A and have the shape shown in FIG. 2A where the heel 75 has an exaggerated pouch shape.

Heel and Toe

The heel and toe are knitted with 25 tex cotton and 29 tex Tactel (Trade Mark) yarn, to give 15 courses per 2.54 cms (1 inch). The heel has a special "Y" configuration which rotates the foot of the sock towards 90 degrees with regard to the leg. Each limb of the "Y" is 2 cm in length. Thus by means of the "Y" configuration extra courses are knitted in to make the heel more pronounced and pouch shaped.

Figure 2D:
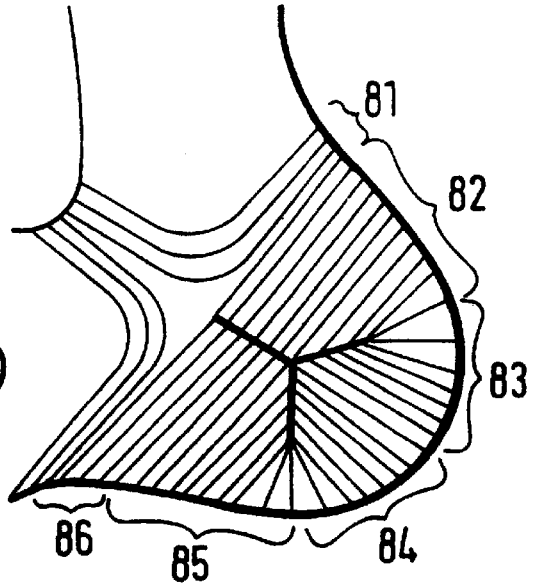
FIGS. 2D and 2E show details of the heel construction of the socks of FIGS. 2A and 2C.
Figure 2E:
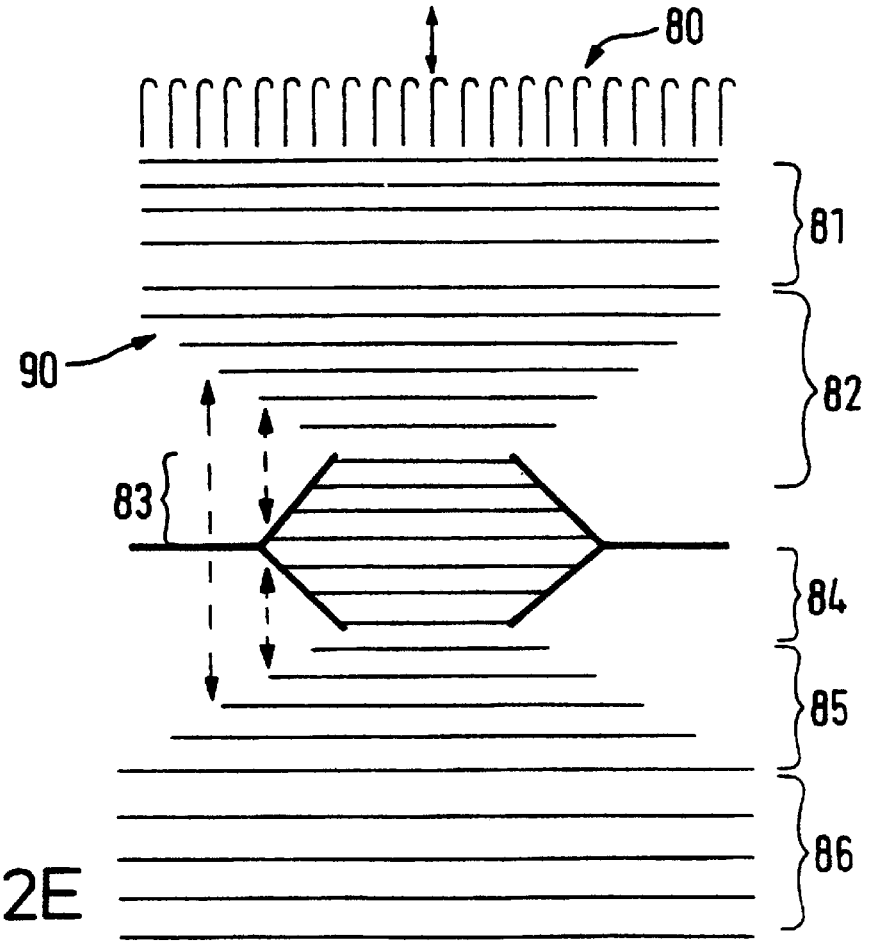

FIG. 2D is a diagrammatic view of the courses in the heel portion 75 of FIG. 2A and 2C. FIG. 2E is a diagrammatic view of the arrangement of the needles 80 and knitting sequence used to form the heel 75.

As can be seen from FIGS. 2D and 2E the "Y" configuration is knitted in six steps. The first step 81 knits a number of courses at the leg width. The second step 82 is a narrowing stage in which needles 90 at the edge of the array hold stitches. The third step 83 is a widening stage. The fourth step 84 is a narrowing stage which mirrors step 83. The fifth step 85 is a widening stage which mirrors step 82. The sixth step 86 knits a number of courses at foot width.

Elastic yarn is laid in only in steps 81 and 86 and is laid-in in every course.

The courses shown in steps 81 and 86 are exaggerated; in the as-knitted structure they lie substantially transverse to the leg and foot portions of the sock respectively.

On the toe, the narrowings are set at 22/21 stitches to give a fairly pointed toe. The toe closing is performed by the linking or Rosso techniques, in order to achieve the flat seam necessary to prevent damage to the membrane.

Figure 4A:
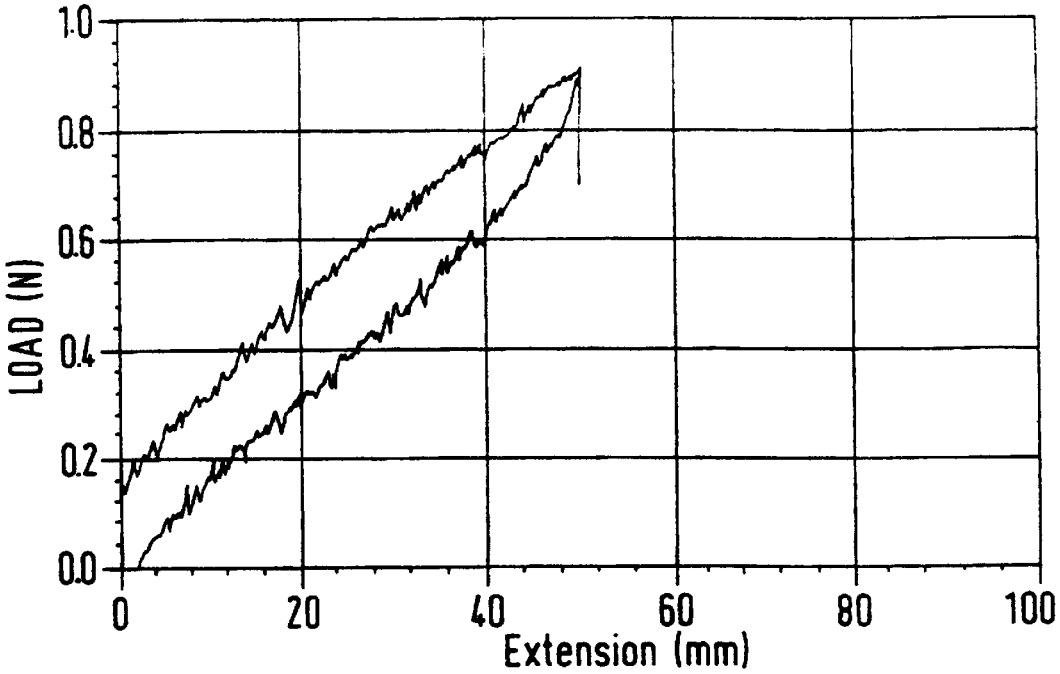
Figure 4B:
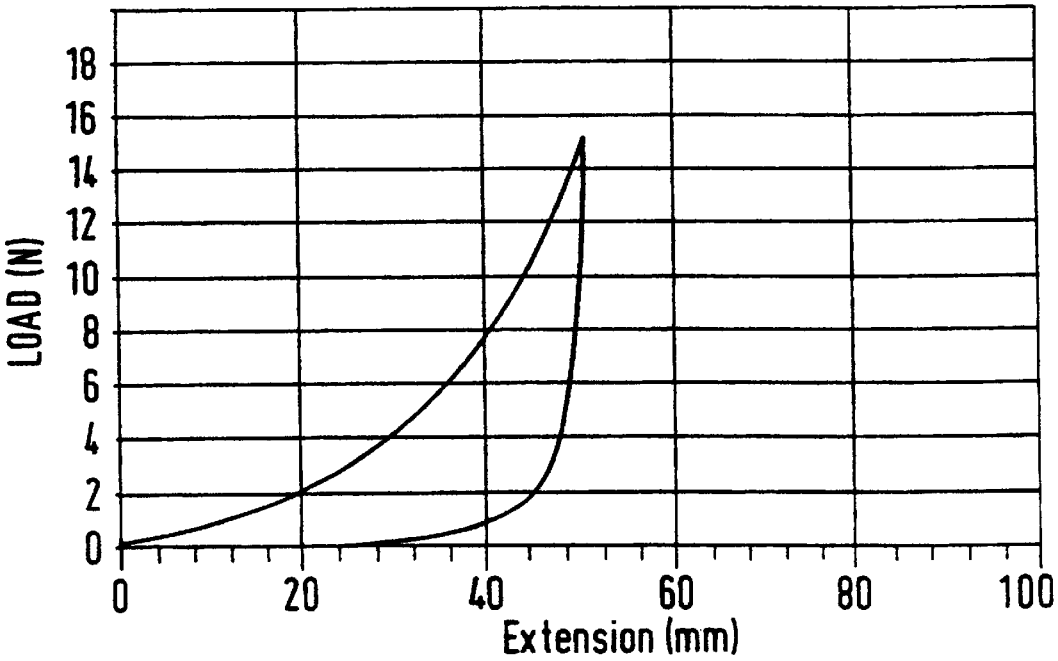
Figure 4C:
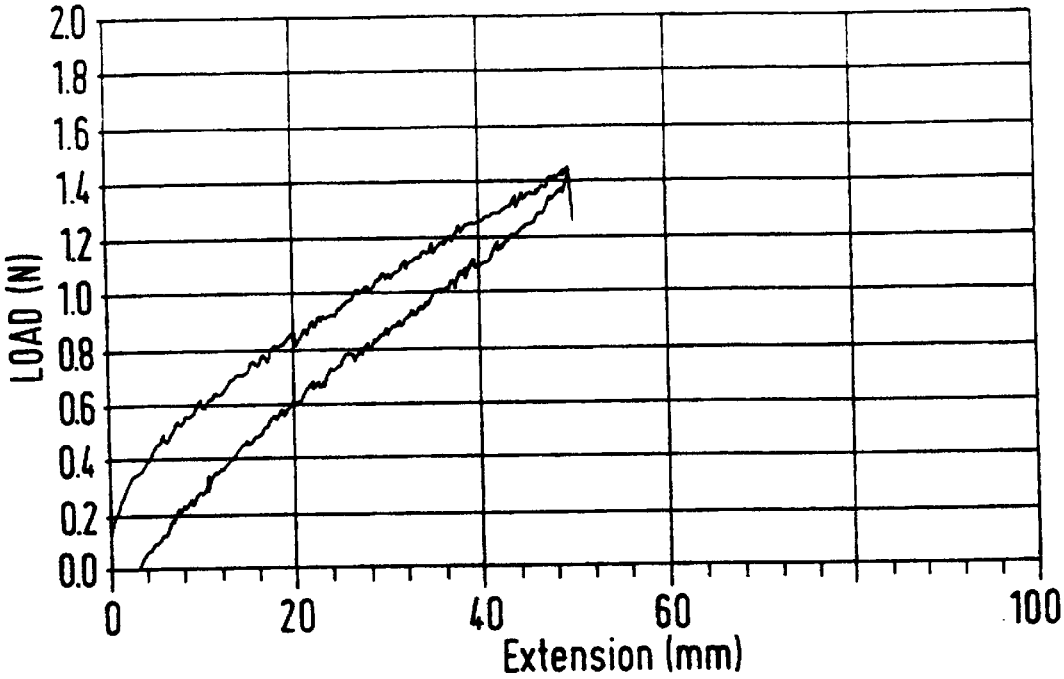
Figure 4D:
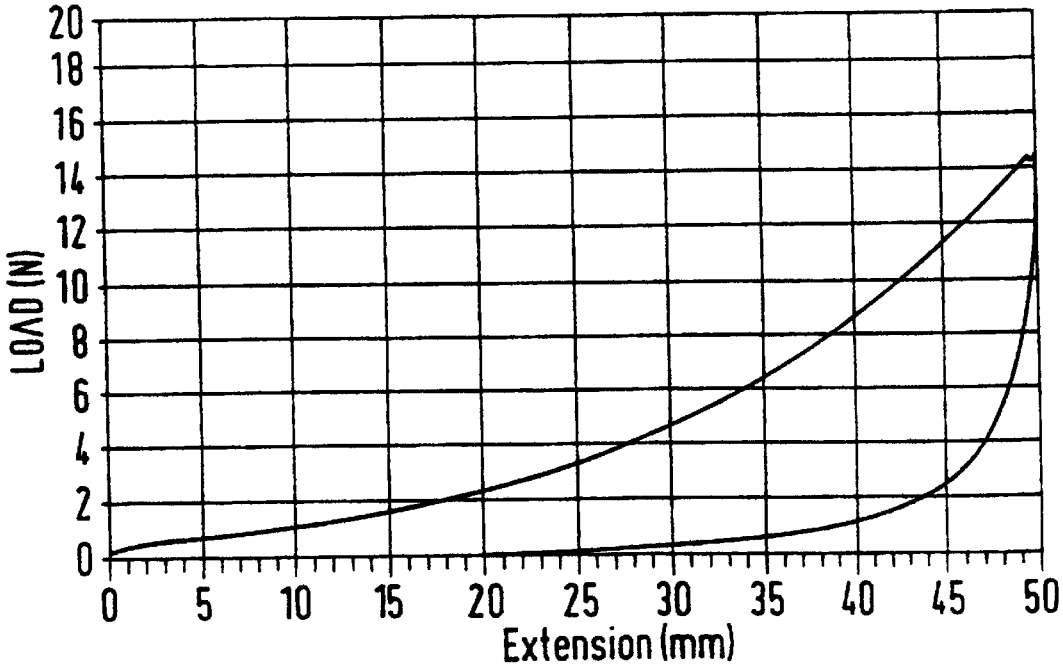

FIGS. 4A–4D are hysteresis curves of the inner sock. FIGS. 4A and 4B were measured on areas (area 71) where every other course has laid in elastic; FIG. 4A in the X direction and FIG. 4B in the Y direction. FIGS. 4C and 4D were measured on areas (area 70) where every course has laid-in elastic; FIG. 4C in the X direction and FIG. 4D in the Y direction. The load at 50% extension, % recovery and power rating are given in Table 1.

In all the Tables the Load values given are the load in Newtons per 5 cm width.

TABLE 1

| | | Load @ 50% ext | Recovery % | Power Rating |
|---|---|---|---|---|
| 1. | Every other course has in-laid elastic: X dir FIG. 4A | 0.9 N | 2% | 68% |
| 2. | Every other course has in-laid elastic: Y dir FIG. 4B | 15 N | 12% | 3% |
| 3. | Every course has in-laid elastic: X dir FIG. 4C | 1.66 N | 3% | 79% |
| 4. | Every course has in-laid elastic: Y dir FIG. 4D | 14.5 N | 15% | 6% |

Figure 5A:
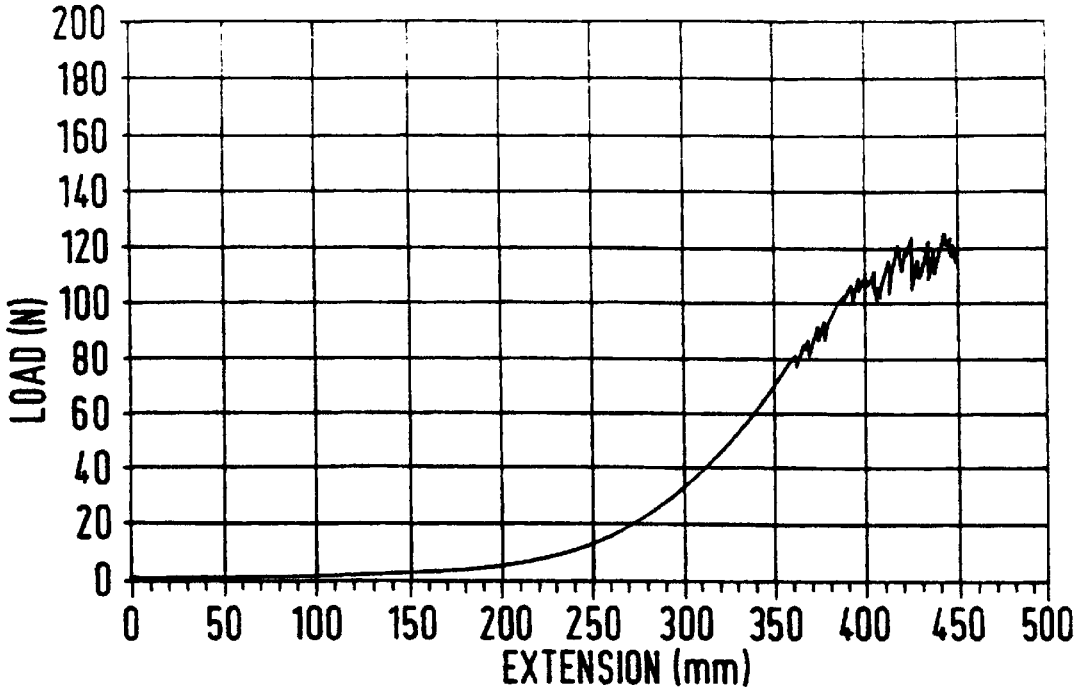
Figure 5B:
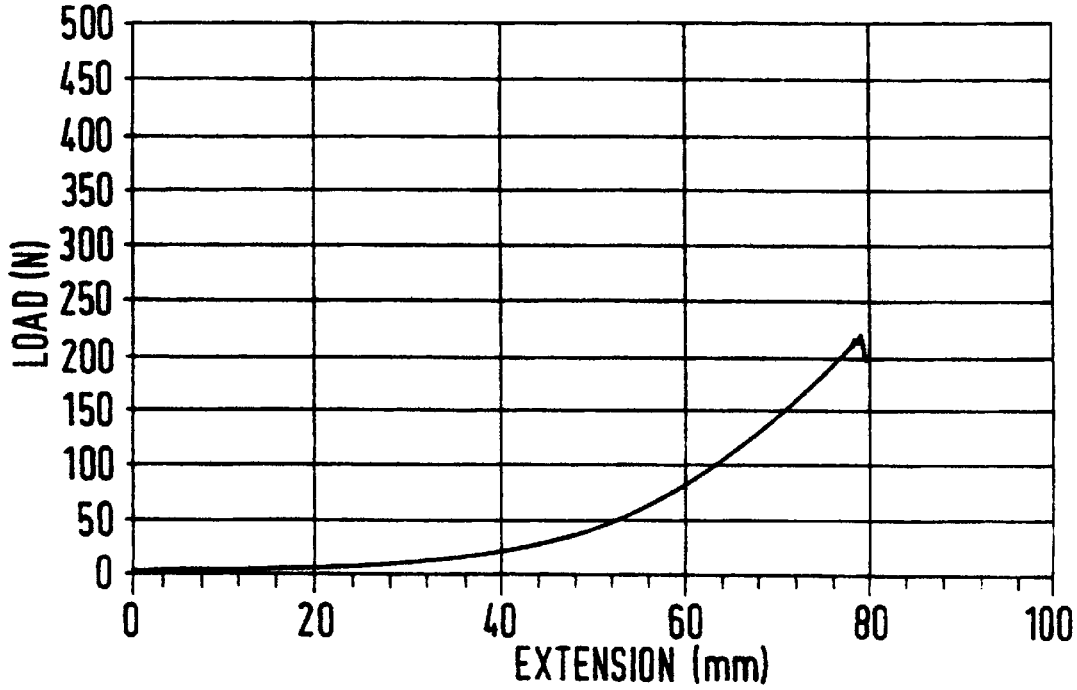
Figure 5C:
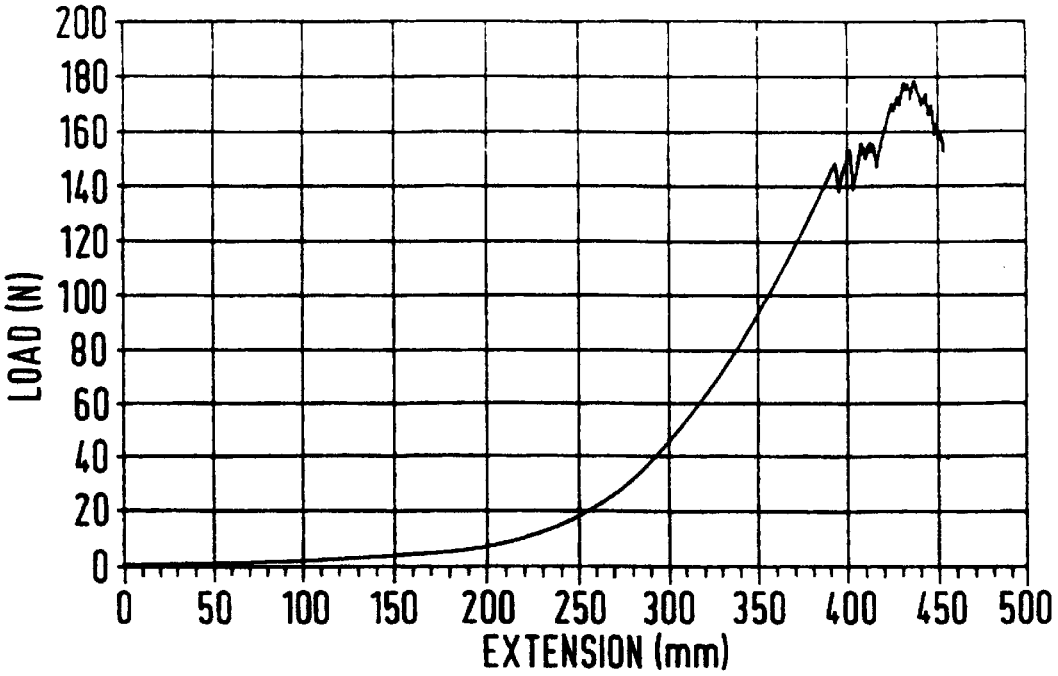
Figure 5D:
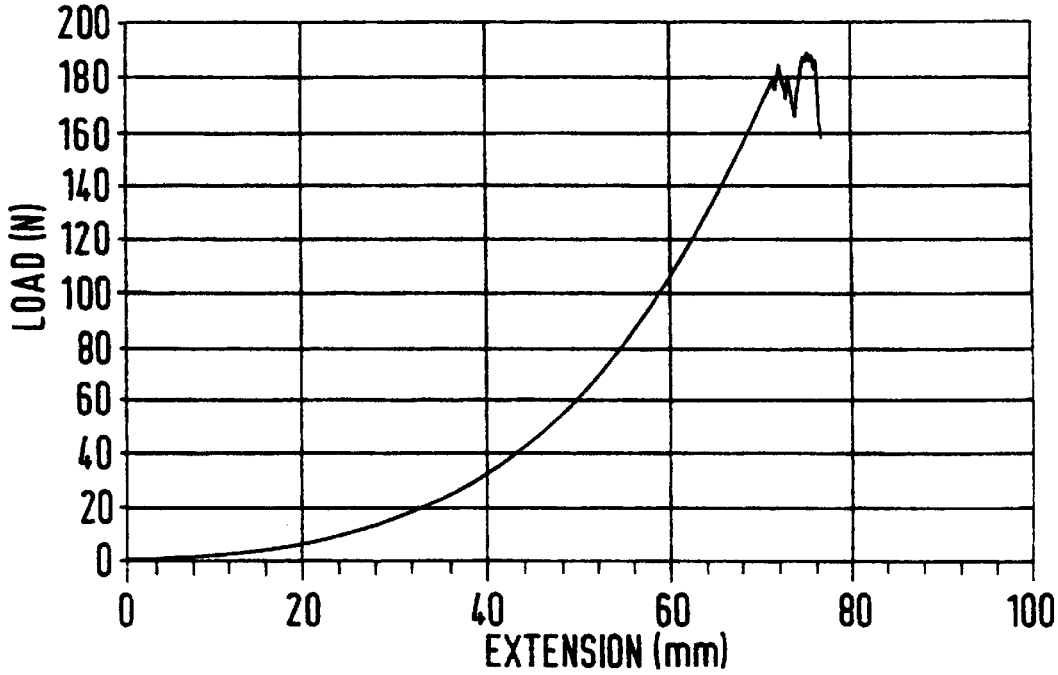

FIGS. 5A and 5B are extension to break curves for area 71 and FIGS. 5C and 5D are extension to break curves for area 70. Load at break and extension at break values are given in Table 2.

TABLE 2

| | | Load @ break | Extension @ break |
|---|---|---|---|
| 5. | Every other course has in-laid elastic: X dir FIG. 5A | 80 N | 361% |
| 6. | Every other course has in-laid elastic: Y dir FIG. 5B | 218 N | 79% |
| 7. | Every course has in-laid elastic: X dir FIG. 5C | 148 N | 389% |
| 8. | Every course has in-laid elastic: Y dir FIG. 5D | 180 N | 71% |

Barrier Component 100—The Membrane 120

The preferred membrane 120 is a waterproof breathable film sold by Porvair International Ltd, King's Lynn, England (and identified as PORELLE V (hereafter P5)) which is 40 microns in thickness and weighs about 50 g/m$^2$. The membrane is a hydrophilic polyurethane, and uses a system of absorption and desorption to transmit water vapour without allowing water droplets to penetrate. This membrane has a water vapour permeability index of 70–90% when measured in accordance with BS 7209, the British Standard Specification for Water Vapour Permeable apparel fabrics. It can withstand a hydrostatic head pressure exceeding 0.7 kg/cm$^2$ (10 psi), measured on a Shirley Hydrostatic Head Tester in accordance with BS3424 Part 26: 1990: Method 29A; Determination of Resistance to Water Penetration and Surface Wetting.

FIGS. 6A and 6B are hysteresis curves for the membrane in the X and Y directions respectively; load at 50% extension, recovery % and power rating are given in Table 3.

TABLE 3

| | Load @ 50% ext | Recovery % | Power Rating |
|---|---|---|---|
| 9. P5 X direction FIG. 6A | 10.8 N | 5.5% | 56% |
| 10. PS Y direction FIG. 6B | 11.5 N | 4% | 55% |

FIGS. 6C and 6D are extension to break curves for the membrane in the X and Y directions and load at break and extension at break are given in Table 4.

TABLE 4

| | Load @ break | Extension @ break |
|---|---|---|
| 11. P5 X direction FIG. 6C | 30 N | 428% |
| 12. PS Y direction FIG. 6D | 45 N | 500% |

Barrier Component 100—Support Fabric 140

The film is reinforced by laminating to a finely knitted polyester support fabric which weighs 38 grams/square meter (gsm). This is 100% polyester, weft inserted, monostretch warp knitted fabric which is sold by Haensel GmbH under the reference 1708E. This fabric is present to prevent the membrane being over extended in the Y direction as the sock is donned and removed.

FIG. 7A is a hysteresis curve for the support fabric in the X direction; when the fabric was stretched in the Y direction it broke at 39% extension and thus a 50% hysteresis curve cannot be produced (and accordingly there is no FIG. 7B). The load at 50% extension, recovery % and power rating for the support fabric is given in Table 5.

With reference to FIG. 7A the curve in fact starts at 0.0 but the material does not begin to extend until a load of approximately 0.1N has been applied.

TABLE 5

| | Load @ 50% ext | Recovery % | Power Rating |
|---|---|---|---|
| 13. Support fabric X direction FIG. 7A | 1.5 N | 8% | 56% |
| 14. Support fabric Y direction | — | — | — |

FIGS. 7C and 7D are extension to break curves for the support fabric in the X and Y directions and load at break and extension at break are given in Table 6.

TABLE 6

| | Load @ break | Extension @ break |
|---|---|---|
| 15. Support fabric X direction FIG. 7C | 120 N | 140% |
| 16. Support fabric Y direction FIG. 7D | 198 N | 39% |

These values clearly show the directional nature of the fabric. When bonded to the membrane it can allow the membrane to accommodate stretch laterally (in the X direction) to help in achieving close fit, whilst restricting the longitudinal stretch of the membrane so as to avoid damage to the membrane (e.g. pin holing) when the sock is being pulled onto the foot.

Barrier Component 100—The Complete Laminate

The laminate of the membrane 120 with the support fabric 140 constitutes the barrier component 100 (see FIG. 1).

The laminate of the film and the support fabric are held together by a polyamide based, thermoplastic adhesive 125 in dot form. The dots are created by applying the adhesive through a screen which has a random pattern of holes, 0.55 mm in diameter, at a density of 52 per square cm. Both outer surfaces (121 and 141) of the laminate are also coated with adhesive dots (55 and 145), which are used to hold the sock together once it is assembled. It is necessary for the adhesive to be discontinuous, i.e. in dot form, so that the ruching of the membrane can occur. The dots on the outer surfaces (121 and 141) are applied using a screen with dot size 0.65 mm, spaced at 22 dots per square cm.

As mentioned above the adhesive is discontinuous. As applied, the adhesive dots 125 for joining the support fabric 140 to the membrane 120 occupy about 12% of the plan area of the barrier component (i.e. when it is flat). The adhesive dots 55 and 145 on the outer surfaces of the barrier component for securing it to the surfaces 51 and 201 occupy, as applied about 7% of the plan area of the barrier component (i.e. when it is flat). On being exposed to heat and pressure during lamination, the adhesive dots may increase slightly in area.

The laminate withstands a hydrostatic head pressure exceeding 0.7 Kg/cm2 (10 psi).

The laminate is cut into oversize sock shapes (see FIG. 2B) which have a leg diameter of 19 cm and a foot diameter of 14.7 cm, measured along lines A and C on FIG. 2B. The shape of the oversize sock shape is a graduated curve from toe to "welt" with no heel position (see FIG. 2B). Pairs of these barrier component shapes are welded, membrane sides together, along their edges to form waterproof and breathable barrier components.

FIG. 8A is a hysteresis curve for the barrier component in the X direction; the material would not perform the extension cycle in the Y direction since it would not stretch to 50% extension, and broke at 230N. This data demonstrates the directional nature of the barrier component. As mentioned above, this is achieved by lamination of the membrane to the support fabric, which prevents excessive stretching of the membrane in the Y direction when the sock is donned and removed, which would damage it.

The load at 50% extension, recovery % and power rating in the X direction are given in Table 7. (There is no FIG. 8B).

TABLE 7

| | Load @ 50% ext | Recovery % | Power Rating |
|---|---|---|---|
| 17. P5 with support fabric: X dir FIG. 8A | 18.6 N | 7% | 37% |
| 18. PS with support fabric: Y dir (no FIG. 8B) | — | — | — |

FIGS. 8C and 8D are extension to break curves for the barrier component in the X and Y directions and load to break and extension at break are given in Table 8.

TABLE 8

| | Load @ break | Extension @ break |
|---|---|---|
| 19. P5 with support fabric: X dir FIG. 8C | 94 N | 106% |
| 20. P5 with support fabric: Y dir FIG. 8D | 230 N | 39% |

Outer Sock 200

The outer sock is a flat knitted sock produced on a 168 needle circular knitting machine with a 10.16 cm (4 inch) diameter cylinder, with different compositions in the leg and foot and in the heel and toe regions.

Leg and Foot Regions

The fibre composition is 25 tex cotton plated with a nylon/elastane air mingled yarn. This elastic yarn is a 22 dtex elastane core with 78 dtex nylon 66. The core is loosely wrapped with air mingled nylon. The plating is performed so that the cotton is on the outer surface of the sock.

The elastane content of the nylon/elastane yarn used in the outer sock is 6.5 by weight. The outer sock contains 30% by weight of the nylon/elastane yarn. Thus the outer sock contains about 2% of elastane. The nylon/elastane yarn can be obtained from Wykes of Leicester, England identified as 5005.

The nylon/elastane yarn was tested on the tensometer as described for the fabrics. Extension by 50% only required a load of 0.05N, recovery was complete (i.e. recovery %=0%) and the power rating was high (in excess of 90%).

Extension to break testing for this nylon/elastane yarn gave a load at break of 3.5N and an extension at break of 350%.

The socks are knitted to a finished width of 9.5 cms leg and foot diameter, measured at points A and C on FIG. 2C.

Heel and Toe

The heel and toe are knitted with 25 tex cotton and 29 tex nylon, to a give 16 courses per 2.54 cm (1 inch). As for the inner component, the heel has a "Y" configuration. Each limb of the "Y" is 2 cm in length. At the toe, the narrowings are set at 22/21. Toe closing is performed by the linking or Rosso techniques, in order to achieve the necessary flat seam.

Welt

The outer sock is knitted with a straight welt 205 which is turned in after the outer sock has been laminated to the barrier component.

FIGS. 9A and 9B are hysteresis curves for the outer sock in the X and Y directions; load at 50% extension, recovery % and power rating are given in Table 9.

TABLE 9

| | Load @ 50% ext | Recovery % | Power Rating |
|---|---|---|---|
| 21. Outer sock: X dir FIG. 9A | 1 N | 5% | 34% |
| 22. Outer sock: Y dir FIG. 9B | 1.8 N | 1% | 40% |

FIGS. 10A and 10B are extension to break curves for the outer sock in the X and Y directions; load at break and extension at break are given in Table 10.

TABLE 10

| | Load @ break | Extension @ break |
|---|---|---|
| 23. Outer sock: X dir FIG. 10A | 134 N | 225% |
| 24. Outer sock: Y dir FIG. 10B | 250 N | 208% |

Assembly Process

The inner sock (see FIG. 2A) is stretched, terry side out, over a former 250. The former 250 (see FIG. 3A) is made from 3 mm thick plastic or metal. It is the same shape as the welded barrier component (see FIG. 2B), and only slightly smaller. The inner sock, originally 9.5 cm in diameter along lines A and C (see FIG. 2A), therefore has to stretch to 155% along C and to 200% along A to fit over the former 250. The welded barrier component is placed over the inner sock with the support fabric facing outwards without stretching. It fits closely.

This assembly is sandwiched between sheets of release paper and pressed in a flat bed press for 30 seconds at a glue line temperature of 120° C. and under a pressure of 1.4 $kg/cm^2$ (20 psi). The purpose of the release paper is to prevent the adhesive dots on the outer surface of the fabric support of the barrier component from sticking to the press. The heat from the press softens the adhesive dots on the inner surface of the barrier component and adheres it to the inner sock.

After this time the work is removed from the press and rotated on the former by approximately 3 cm. It is pressed again for a further 30 seconds at the same temperature and pressure. The rotation of the work allows the material which lay along the edges of the former during the initial pressing to be laminated.

The composite is removed from the former, soaked in water, and dried. This promotes elastic recovery of the inner sock so that when dry the barrier component has corrugated or ruched in the spaces between the points where it is adhered to the inner sock, this may involve folding down between the ribs in the ribbed construction.

The composite is stretched over a second former 260 as shown in FIG. 3B. This former is made from the same material as the first, but is different in shape. Instead of a smooth curve as in the former 250 (see FIG. 3A), a heel shape 210 is introduced into the former 260 to rotate the foot towards the position that the sock will assume when worn. The dimensions of the former 260 are 13 cm at C (the foot) and 15.5 cm at A (the leg) when measured along the lines C and A on FIG. 3B. The outer sock is applied over the composite with its cotton face outermost. The heel of the outer sock is lined up with the heel of the inner sock, and the material adjusted so that it is distributed evenly around the board.

This assembly is pressed in a flat bed press for 30 seconds at a glue line temperature of 120° C. and under a pressure of 1.4 kg/cm$^2$ (20 psi). It is removed, the composite rotated on the former as before, and pressed again.

After pressing the laminated sock is removed from the former, washed in water at 40° C. and treated with a cationic fabric conditioner to improve the handle of the finished sock. It is then dried. The sock recovers to its final size due to the elastication.

The welt of the outer sock is turned in so that its edge covers the edge of the inner sock and barrier component, and it is sewn in position with a blind hemming machine, using polyester thread.

The Waterproof and Breathable Sock

The finished sock withstands a hydrostatic head pressure in excess of 0.7 kg/cm$^2$ (10 psi).

The complete sock exhibited a water vapour permeability index of 50–60% when tested in accordance with BS3424 Part 34 1992: Method 37: Determination of Water Vapour Permeability index.

The sock has a leg width of 9.5 cm, and a foot width of 9.5 cm, as measured alng the lines A and C on FIG. 2C.

Table 11 tabulates the leg, foot and heel to ankle widths of the components and the formers and the finished sock.

TABLE 11

| | leg width at A cms | foot width at C cms | heel to ankle width at B cms |
|---|---|---|---|
| Inner sock as knitted (FIG. 2A) | 9.5 | 9.5 | 12 |
| Former 250 (FIG. 3A) | 18.8 | 14.5 | 18.2 |
| Barrier component (FIG. 2B) | 19 | 14.7 | 18.4 |
| Outer sock as knitted (FIG. 2C) | 9.5 | 9.5 | 12 |
| Former 260 (FIG. 3B) | 15.5 | 13 | 16.2 |
| Finished sock | 9.5 | 9.5 | 12 |

The dimensions AI, BI and CI are for the inner sock; AO, BO and CO are for the outer sock.

As can be seen from Table 11 the inner sock stretches at A from 9.5 to 18.8, i.e. the increase in AI is to 198%; at C from 9.5 to 14.5, i.e. the increase in CI is to 153%; at B from 12 to 18.2, i.e. the increase in BI is to 152%. Also with reference to Table 11 the outer sock stretches at A from 9.5 to 15.5, i.e. the increase in AO is to 163%; at C from 9.5 to 13, i.e. the increase in CO is to 137%; at B from 12 to 16.2, i.e. the increase in BO is to 135%.

Thus the ratio AO/AI % increase in AO (63%) to AI (98%) is 0.64:1; the ratio CO/CI is 37/53 or 0.7:1; and the ratio BO/BI is 35/52 or 0.67:1. More broadly the ratios AO/AI, CO/CI and BO/BI are desirably each in the range 0.2:1 to 0.9:1 or 0.3:1 to 0.8:1. If the outer sock is stretched too much it will itself ruch or wrinkle and give an unacceptable appearance to the exterior of the sock. If the outer sock is stretched too little it will prevent the barrier component being able to extend sufficiently to make proper use of the ruching, i.e. the sock will no longer be able to be drawn easily over the heel.

Figure 11A:
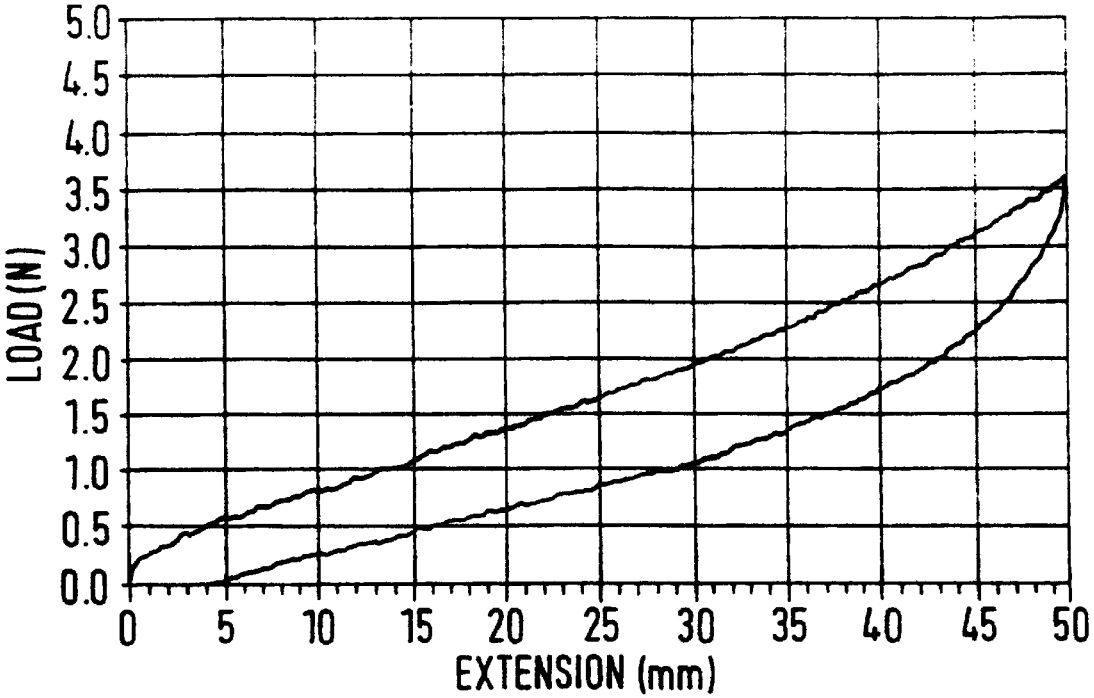
Figure 11B:
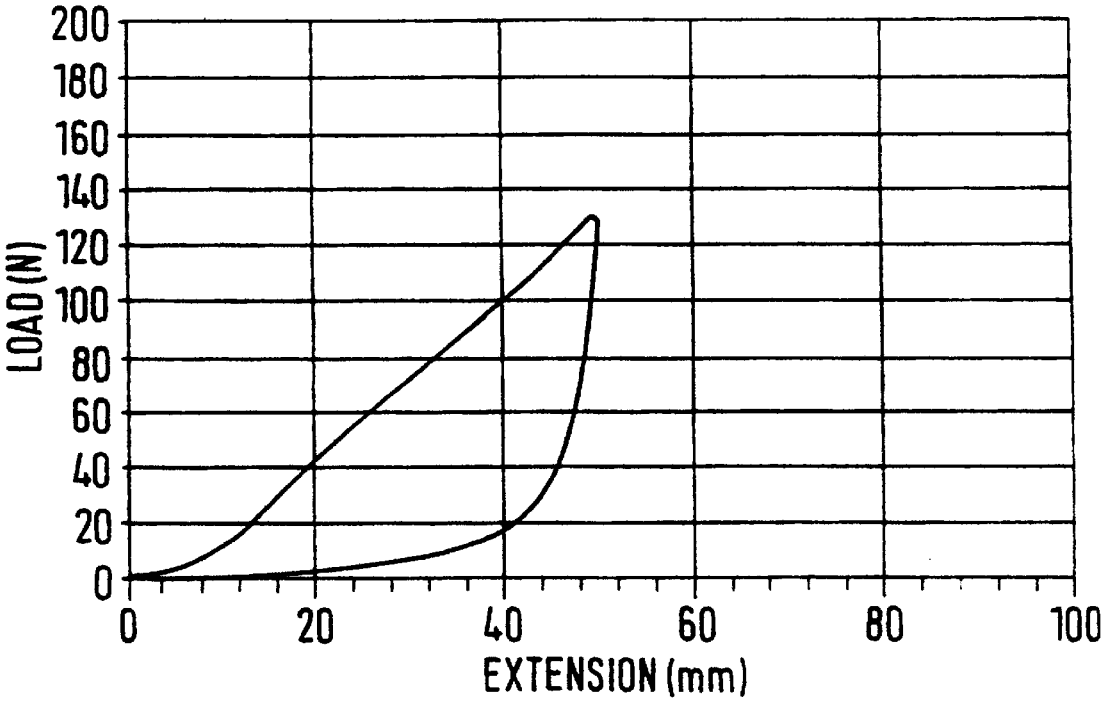
Figure 11C:
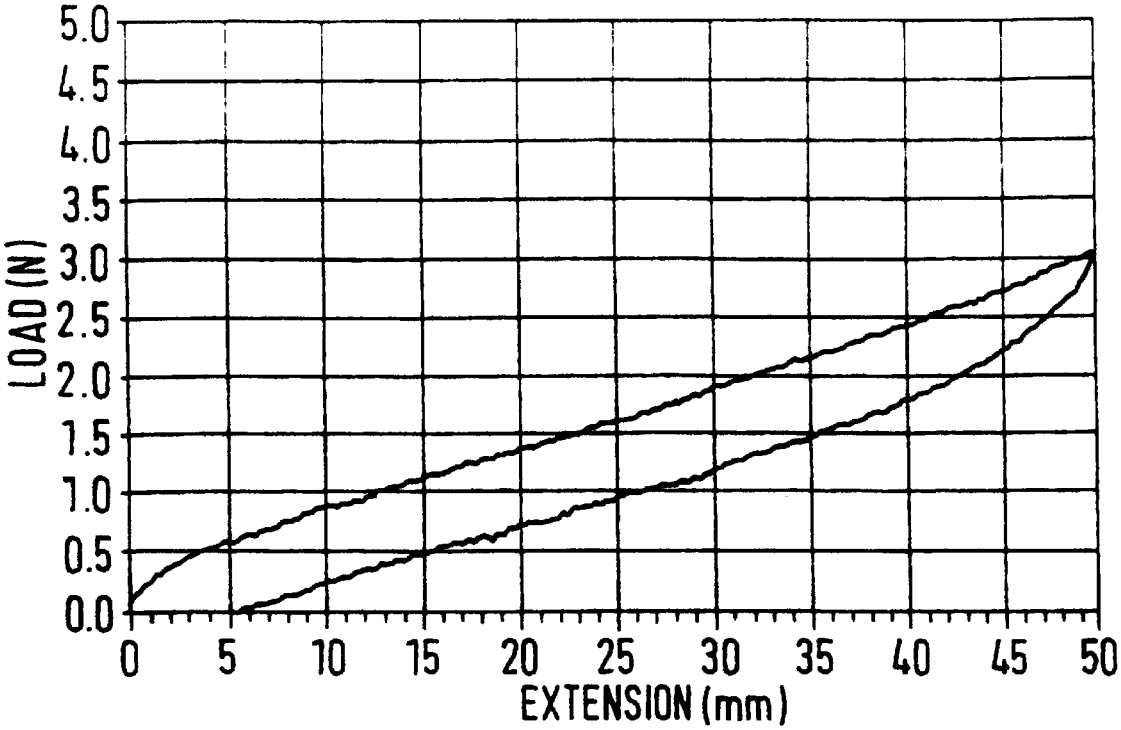
Figure 11D:
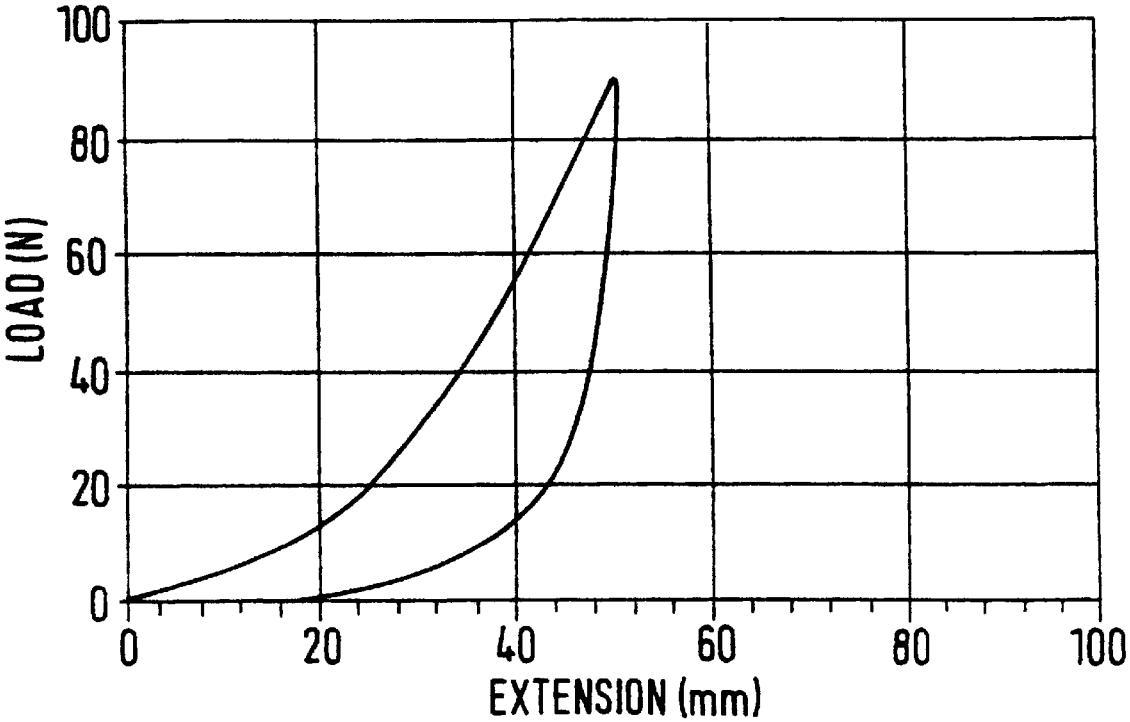
Figure 11E:
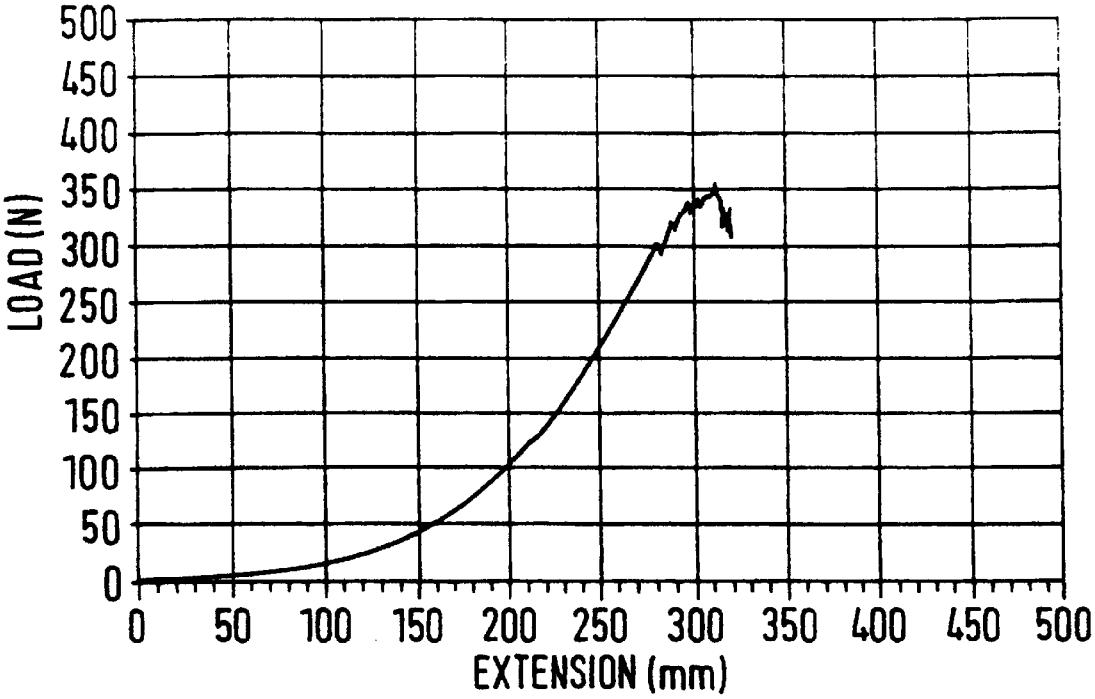
Figure 11F:
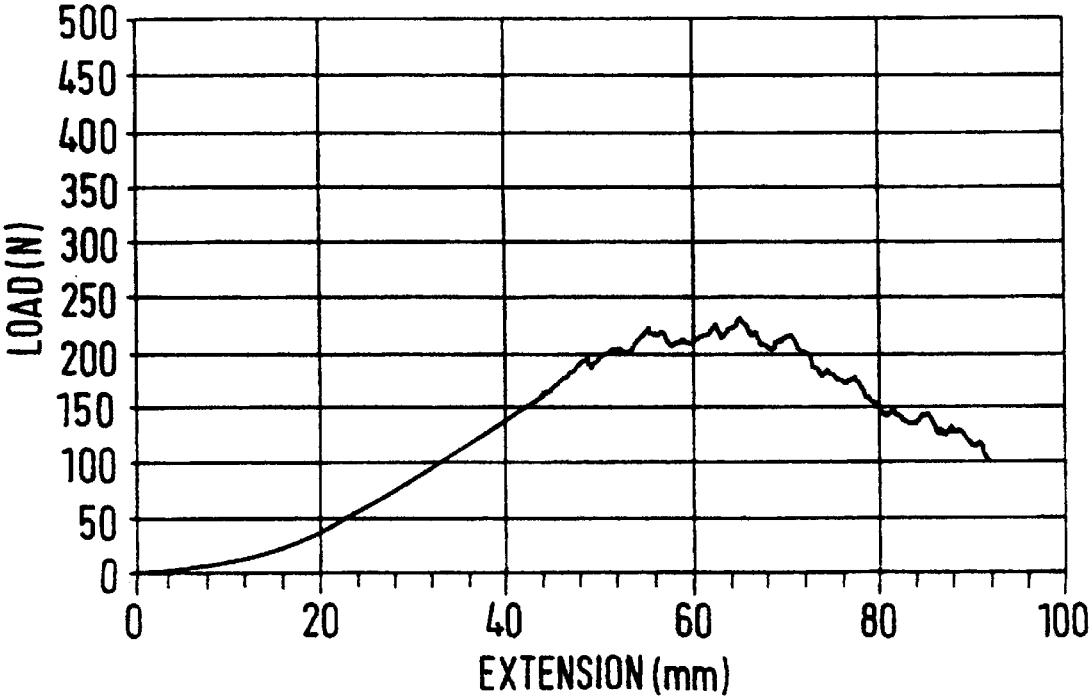
Figure 11G:
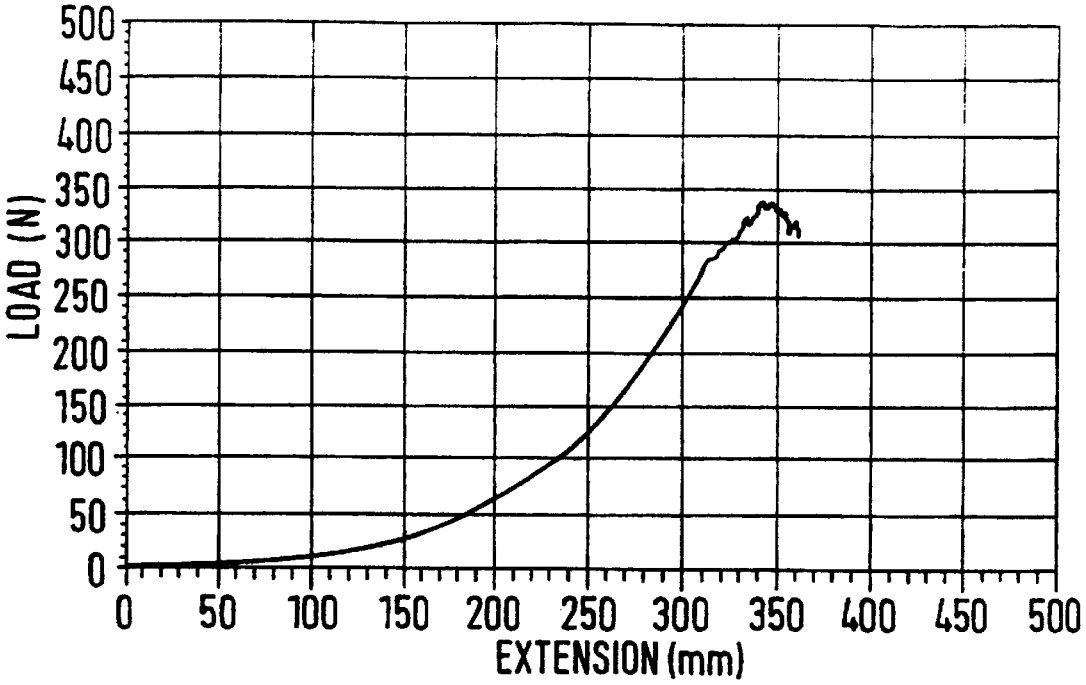
Figure 11H:
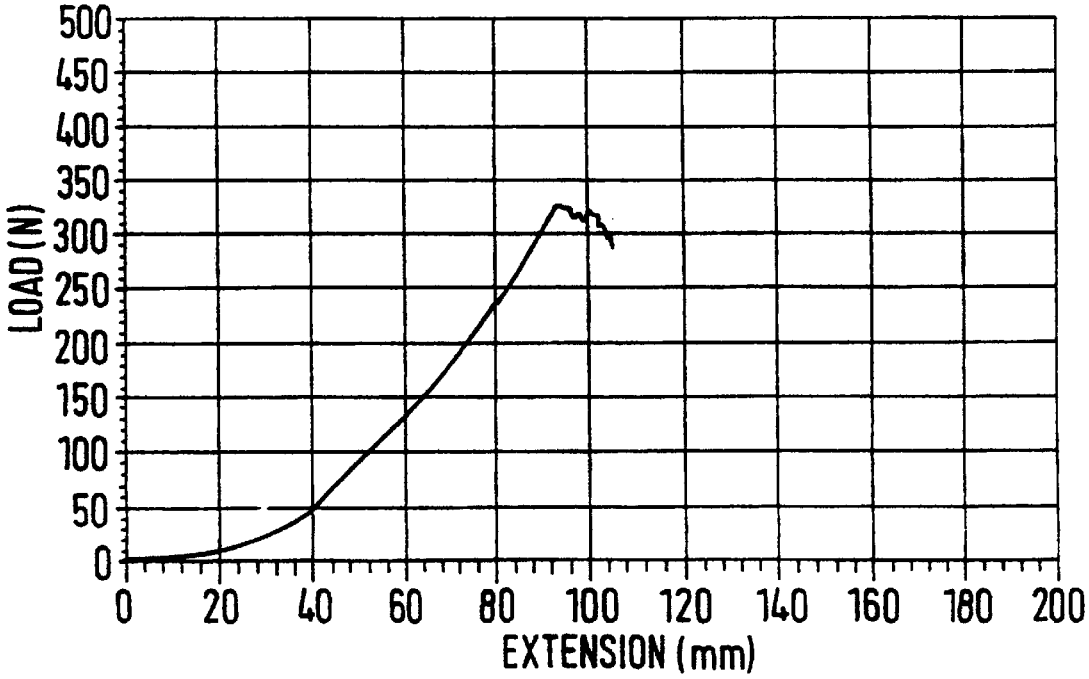

FIGS. 11A, 11B, 11C and 11D are hysteresis curves for the complete sock; FIGS. 11A and 11B being for the region of the sock where the inner sock has elastic every other course (i.e. the area 71) in the X and Y directions; FIGS. 11C and 11D being for the region of the sock where the inner sock has elastic every course (i.e. the area 70) in the X and Y directions. The values of load at 50% extension, recovery % and power rating are given in Table 12.

TABLE 12

| | Load @ 50% ext | Recovery % | Power Rating |
|---|---|---|---|
| 25. Complete sock: where inner has elastic every other course: X dir FIG. 11A | 3.6 N | 5% | 48% |
| 26. Complete sock: where inner has elastic every other course: Y dir FIG. 11B | 130 N | 12% | 7% |
| 27. Complete sock: where inner has elastic every course: X dir FIG. 11C | 3 N | 5.5% | 63% |
| 28. Complete sock: where inner has elastic every course: Y dir FIG. 11D | 88 N | 16% | 14% |

FIGS. 11E, 11F, 11G and 11H correspond to FIGS. 11A to 11D and are extension to break curves. Table 13 gives the load at break and extension at break.

TABLE 13

| | Load @ break | Extension @ break |
|---|---|---|
| 29. Complete sock: where inner has elastic every other course: X dir FIG. 11E | 300 N | 281% |
| 30. Complete sock: where inner has elastic every other course: Y dir FIG. 11F | 191 N | 49% |
| 31. Complete sock: where inner has elastic every course: X dir FIG. 11G | 300 N | 319% |
| 32. Complete sock: where inner has elastic every course: Y dir FIG. 11H | 325 N | 93% |

It will be noted that the inner and outer socks are knitted and in this specific embodiment both are circular knitted socks.

It will also be noted in this specific embodiment that the inner sock has elastic yarns laid-in in the X-direction, the outer sock is circular knitted from yarns, some of which contain elastic.

The amount of elastic yarn in the inner sock is more than in the outer sock.

It will also be noted that the elastic yarn does not have to be laid-in to every course and indeed the frequency of laying in can vary from region to region of the sock.

EXAMPLE 2

Socks made as described below have been subject to wear trials and have survived in excess of 200 hours wearing and 10 concomitant washings, whilst retaining their as-knitted dimensions, namely the length (A) (at the leg) remained at 9.5 cm and the length (C) (at the foot) remained at 9.5 cm. In addition the same socks after such use exhibited a load at 50% extension of only 6.1N compared to 5.4 for socks made to the same specification before use, a % recovery of 6% as compared to 4% for socks made to the same specification before use, and a power rating of 50% as compared to 63% for socks made to the same specification before use.

Inner Sock

The leg and foot were knitted with 14 tex nylon with 25 tex cotton used for the terry loop and on the face. The elastication was as Example 1, but with the area 70 extending 7 cm up the leg, and 5 cm along the foot. The socks were knitted to a finished width of 9.5 cm leg and foot diameter, measured along the lines A and C as in Example 1.

The heel and toe were knitted with 25 tex cotton and 29 tex nylon and had terry construction. As in Example 1, they were knitted to give 15 courses per 2.54 cm.

The Y heel and the narrowings at the toe were as in Example 1.

The barrier component was as in Example 1.

Outer Sock

The outer sock was a flat knitted sock produced on a 200 needle circular knitting machine with a 9.53 cm (3.75 inch) diameter cylinder. The leg and foot were knitted as in Example 1, and to a finished width of 9.5 cm leg and foot, measured along the lines A and C as in Example 1.

The heel and toe were knitted with 25 tex cotton and 29 tex nylon, and had full terry consruction. They were knitted to give 17–18 courses per 2.54 cm. The Y heel and narrowings at the toe were as in Example 1.

Assembly

The assembly process was similar to that specified in Example 1, except that the inner sock was put over the first former with the terry loop against the former. To activate the adhesive, a continuous press was used.

After the final lamination, the sock was removed from the second former and treated with a cationic fabric softener for 20 minutes at 45° C.

In addition the socks remained waterproof and did not demonstrate pinholing. These socks had elastic yarn laid-in to every course in the area 70. Equivalent socks made without the support fabric demonstrated pinholing soon after use began and thus ceased to be waterproof after only a few cycles of donning, wear, removal and washing.

Equivalent socks made to the same specification but without the laid-in elastic do not have elastic properties which cause them to recover to the width of the ankle after being extended over the long heel during donning of the sock. Such socks do not fit closely when new and will fit even less closely after repeated wearings and washings. If such socks are made small enough to fit the ankle closely, then they cannot be put on, the force needed to extend the sock over the heel being too great, and likely to result either in damage to the sock or injury to the wearer.

EXAMPLES 3–5

Composite socks in accordance with the invention were made up from inner and outer socks which were different from those used in example 1. The properties of the as-made composite socks, prior to use, are given in Table 14 below.

TABLE 14

| Exam -ple | sock inn- er | outer | load at 50% extn | recovery % | power rating |
|---|---|---|---|---|---|
| 3 | A | A | 4.3 | 3 | 78 |
| 4 | B | B | 3.6 | 3 | 72 |
| 5 | A | C | 4.1 | 5 | 62 |

Sock A is a mock 1×1 rib construction, without terry. It was knitted on a 156 needle circular knitting machine with an 8.9 cm (3.5 inch) cylinder diameter. The fibre composition was 1/30s Nm polyester (Coolmax TM) plated with 1/70s Nm nylon (leg and foot) and 1/30s Nm polyester (Coolmax TM) plated with 2/70s Nm nylon (heel and toe). The rubber elastic yarn was. Wykes 100s rubber core covered with two 1/78 Nm, 20 filament textured nylon 66 yarns laid-in in every course. The sock was knitted to a finished width of 9 cm leg and foot diameters measured along the lines A and C.

Sock B is a mock 1×1 rib sandwich terry construction. It was knitted on a 168 needle circular knitting machine with a 10 cm (4 inch) cylinder diameter. The fibre composition was 1/24 Ne cotton backing yarn with 1/70 Nm nylon (Tactel TM) used for the terry loop and on the face (leg and foot), and 1/24 Ne cotton and 2/70 Nm nylon (Tactel TM) (heel and toe). The rubber elastic yarn was wykes 100s rubber core covered with two 1/78 Nm, 20 filament textured nylon 66 yarns laid-in in every course.

The sock was knitted to a finished width of 9.5 cm leg and foot diameters measured along the lines A and C.

Sock C is flat knit construction. It was knitted on a 168 needle circular knitting machine with a 10 cm (4 inch) cylinder diameter. The fibre composition for both the leg and foot and heel and toe regions was 1/24 Ne cotton yarn with 2/70 Nm nylon backing yarn. This sock does not contain a rubber elastic yarn.

The sock was knitted to a finished width of 9.5 cm leg and foot diameters measured along the lines A and C.

It will be recognised that the structure of the socks of the present invention is such that there are no seams in the socks themselves (except for the toe closure) and that there is but a single welded seam in the barrier component. This avoids the need for taped and stitched seams and increases the comfort of the sock on the foot. The risk of abrasion, blisters or discomfort due to the presence of stitched and taped seams as used in the prior art is avoided.

Since the seam is not stitched the risk of leakage through the seams due to imperfect taping is also avoided.

What is claimed is:

1. A composite sock which consists of an inner stretchable fabric envelope, a [bag-like] barrier component in the form of a bag which is liquid water impermeable, and water vapour permeable, and a second or outer stretchable fabric envelope, the inner envelope being attached to the barrier component, the barrier component being attached to the outer envelope, the arrangement being such as to allow circumferential stretching of the composite sock, wherein the inner stretchable fabric envelope or the outer stretchable fabric envelope or both is a circular knitted sock, the composite sock has elastic properties such that it can be stretched at least in the circumferential direction to at least 50% extension, and such that when a sample taken from the leg of the composite sock just above the ankle, the sample being 5 cm by 10 cm with the 10 cm dimension aligned in the circumferential direction, is extended on a tensometer at 100 mm per minute by 50% to 15 cms length and the sample is allowed to recover at 100 mm/minute, producing a hysteresis curve, the load at 25% extension during the recovery stage is at least 50% of the load at 25% extension during the stretching stage.

2. A composite sock as claimed in claim 1 wherein the load to stretch the sample in the circumferential direction to 50% extension is less than 15N per 5 cm width.

3. A composite sock as claimed in claim 1 wherein on release of the pulling load, in such a way that the sample recovers at 100 mm/minute, the sample recovers to within 12.5% of its original 10 cms length.

4. A composite sock as claimed in claim 2 wherein on release of the pulling load, in such a way that the sample recovers at 100 mm/minute, the sample recovers to within 12.5% of its original 10 cms length.

5. A composite sock which consists of an inner stretchable sock, a barrier component in the form of a bag which is liquid water impermeable, and water vapour permeable, and an outer stretchable sock, the inner sock being attached to the barrier component, the barrier component being attached to the outer sock, the arrangement being such as to allow circumferential stretching of the composite sock, wherein the inner sock and the outer sock are circular knitted socks and wherein the inner or the outer sock or both have elastic properties such that the composite sock has elastic properties such that it can be stretched at least in the circumferential direction to at least 50% extension, and such that when a sample taken from the leg of the composite sock just above the ankle, the sample being 5 cm by 10 cm with the 10 cm dimension aligned in the m circumferential direction, is extended on a tensometer at 100 mm per minute by 50% to 15 cms length;

(i) the load to stretch the sample in the circumferential direction to 50% extension is less than 15N per 5 cm width;

(ii) on release of the pulling load, in such a way that the sample recovers at 100 mm/minute, the sample recovers to within 12.5% of its original 10 cms length, defined as the recovery %; and (iii) when the sample is allowed to recover at 100 mm/minute, producing a hysteresis curve, the load at 25% extension during the recovery stage, defined as the power rating, is at least 50% of the load at 25% extension during the stretching stage.

6. A composite sock as claimed in claim 5 wherein the 50% extension load of the composite sock is less than 7.5N, the recovery % is to within 7.5% and the power rating is at least 60%.

7. A composite sock as claimed in claim 6 wherein the 50% extension load of the composite sock is less than 5N, the recovery % is to within 5% and the power rating is in the range 60 to 80%.

8. A composite sock which comprises an inner sock, a barrier component in the form of a bag which is liquid water impermeable, and water vapour permeable, and a second or outer knitted fabric, the inner sock being attached to the barrier component, the second or outer fabric being disposed over the outer surface of the barrier component and being attached thereto, the attachment being such as to allow circumferential stretching of the sock, wherein the attachment is such as to allow circumferential stretching of the sock at least in the circumferential direction to at least 50% extension, and wherein the inner sock is a circular knit sock, the inner sock having elastic yarns laid-in in circumferential direction courses of the composite sock, so that the ability of the composite sock when stretched laterally to recover to, or towards, its original unstretched shape and dimensions is enhanced.

9. A composite sock as claimed in claim 8 wherein elastic yarns are laid-in to a number of circumferential direction courses at least in the region of the ankle.

10. A composite sock as claimed in claim 8, wherein the composite sock consists of the inner sock, the barrier component and the fabric.

11. A composite sock which comprises an inner sock, a barrier component in the form of a bag which is liquid water impermeable, and water vapour permeable, and an outer sock, the inner sock being attached to the barrier component, the barrier component being attached to the outer sock, the attachment being such as to allow circumferential stretching of the sock, wherein the attachment is such as to allow circumferential stretching of the sock to at least 50% extension, and wherein the inner sock and the outer sock are circular knit socks, the inner sock or the outer sock or both having elastic yarns laid-in in courses circumferentially of the sock so that the ability of the sock when stretched laterally to recover to, or towards, its original unstretched shape and dimensions is enhanced.

12. A composite sock as claimed in claim 11 wherein elastic yarns are laid-in to a number of circumferential direction courses at least in the region of the ankle.

13. A composite sock as claimed in claim 12 wherein the elastic yarns are laid-in in circumferential direction courses throughout the sock.

14. A composite sock as claimed in claim 13 wherein the elastic yarns are laid-in to every circumferential direction course or every other circumferential direction course, at least in the region of the ankle or throughout the sock.

15. A composite sock as claimed in claim 11 wherein the elastic yarns are laid-in to every circumferential direction course or every other circumferential direction course, at least in the region of the ankle or throughout the sock.

16. A composite sock as claimed in claim 11 wherein when a sample taken from the leg of the composite sock just above the ankle, the sample being 5 cm by 10 cm with the 10 cm dimension aligned in the circumferential direction, is extended on a tensometer at 100 mm per minute by 50% to 15 cms length, and the sample is allowed to recover at 100 mm/minute, producing a hysteresis curve, the load at 25% extension during the recovery stage, defined as the power rating, is at least 50% of the load at 25% extension during the stretching stage.

17. A composite sock as claimed in claim 16 wherein the load to stretch the sample in the circumferential direction to 50% extension is less than 15N per 5 cm width.

18. A composite sock as claimed in claim 16 wherein on release of the pulling load, in such a way that the sample recovers at 100 mm/minute, the sample recovers to within 12.5% of its original 10 cms length, defined as the recovery %.

19. A composite sock as claimed in claim 16 wherein the 50% extension load of the composite sock is less than 7.5N, the recovery % is to within 7.5% and the power rating is at least 60%.

20. A composite sock as claimed in claim 19 wherein the 50% extension load of the composite sock is less than 5N, the recovery % is to within 5% and the power rating is in the range 60 to 80%.

21. A composite sock as claimed in claim 11 wherein the barrier component comprises a liquid water impermeable, water vapor permeable membrane reinforced by a support fabric, the barrier component being corrugated or ruched in the unstretched state so that it can accommodate circumferential stretching of the inner sock on stretching thereof, the barrier component being constrained against stretching in the toe-to-calf longitudinal direction by the support fabric, which does not interfere with the circumferential expansion of the ruched barrier component.

22. A composite sock as claimed in claim 21 wherein the support fabric is extensible by less than 50% in the toe-to-calf or Y-direction.

23. A composite sock as claimed in claim 21 wherein the inner sock is a circular knitted sock and wherein the membrane is reinforced by a support fabric, and wherein the outer surface of the inner sock is attached to the inner surface of the barrier component by spaced apart dots of adhesive, the membrane being attached to the support fabric by spaced apart dots of adhesive whereby the barrier component is constrained against stretching in the toe-to-calf longitudinal direction by the support fabric, and the laid-in elastic yarn ensures a close fit of the sock to the foot and leg of the wearer.

24. A composite sock as claimed in claim 21, wherein the barrier component consists of the membrane reinforced by the support fabric.

25. A composite sock as claimed in claim 11, wherein the barrier component consists of a liquid water impermeable, water vapor permeable membrane reinforced by a support fabric, further wherein the outer surface of the barrier component is attached to the inner surface of the outer sock by spaced apart dots of adhesive.

26. A composite sock as claimed in claim 11, wherein the composite sock consists of the inner sock, the barrier component and the outer sock.

27. A composite sock which comprises an inner stretchable fabric sock, a barrier component in the form of a bag which is liquid water impermeable, and water vapour permeable, the inner sock being attached to the barrier component, the arrangement being such as to allow circumferential stretching of the composite sock, wherein the arrangement is such as to allow circumferential stretching of the sock at least in the circumferential direction to at least 50% extension, wherein the inner sock has elastic yarns laid-in in circumferential direction courses of the composite sock, the barrier component comprising a liquid water impermeable, water vapour permeable membrane reinforced by a fabric support, the barrier component being corrugated or ruched in the unstretched state so that it can accommodate circumferential stretching of the inner sock on stretching thereof, the barrier component being constrained against stretching in the toe-to-calf longitudinal direction by the support fabric, which does not interfere with the circumferential expansion of the ruched barrier component.

28. A composite sock as claimed in claim 27 wherein the support fabric is extensible by less than 50% in the toe-to-calf or Y-direction.

29. A composite sock as claimed in claim 27, wherein the composite sock consists of the inner sock and the barrier component, and the barrier component consists of the membrane reinforced by the fabric support.

30. A composite sock which comprises an inner stretchable sock, a barrier component in the form of a bag which is liquid water impermeable, and water vapour permeable, and an outer stretchable sock, the inner sock being attached to the barrier component, the barrier component being attached to the outer sock, the attachment being such as to allow circumferential stretching of the sock, wherein the attachment is such as to allow circumferential stretching of the sock to at least 50% extension, and wherein the inner sock or the outer sock or both are circular knit socks having elastic yarns laid-in in circumferential direction courses of the composite sock, the barrier component comprising a liquid water impermeable, water vapour permeable membrane reinforced by a fabric support, the barrier component being corrugated or ruched in the unstretched state so that it can accommodate circumferential stretching of the inner and outer socks on stretching thereof, the barrier component being constrained against stretching in the toe-to-calf longitudinal direction by the support fabric, which does not interfere with the circumferential expansion of the ruched barrier component.

31. A composite sock as claimed in claim 30 wherein the support fabric is extensible by less than 50% in the toe-to-calf or Y-direction.

32. A composite sock as claimed in claim 30, wherein the composite sock consists of the inner sock, the barrier component and the outer sock, and the barrier component consists of the membrane reinforced by the fabric support.

33. A composite sock which comprises an inner sock, and a barrier component in the form of a bag comprising a liquid water impermeable, water vapour permeable membrane wherein the inner sock is a circular knitted sock and wherein the membrane is reinforced by a fabric support, the outer surface of the inner sock being attached to the inner surface of the barrier component by spaced apart dots of adhesive, the membrane being attached to the support fabric by spaced apart dots of adhesive, the inner sock having elastomeric yarn laid-in to a number of circular courses at least in the region of the ankle, the barrier component being corrugated or ruched, when the sock is in the unstretched state, so that it can accommodate circumferential stretching of the inner sock on initial stretching thereof and being circumferentially elastic so as also to be able to stretch circumferentially on further circumferential stretching of the inner sock, to at least 50% extension, the barrier component being constrained against stretching in the toe-to-calf longitudinal direction by the support fabric, and the laid-in elastomeric yarn ensuring a close fit of the sock to the foot and leg of the wearer.

34. A composite sock as claimed in claim 33, wherein the composite sock consists of the inner sock and the barrier component, and the barrier component consists of the membrane reinforced by the fabric support.

35. A composite sock which comprises an inner circular knitted sock, a barrier component in the form of a bag comprising a liquid water impermeable, water vapour permeable membrane reinforced by a fabric support, and an outer circular knitted sock, the outer surface of the inner sock being attached to the inner surface of the barrier component by spaced apart dots of adhesive, the outer surface of the barrier component being attached to the inner surface of the outer sock by spaced apart dots of adhesive, the membrane being attached to the support fabric by spaced apart dots of adhesive, the inner or the outer sock or both having elastomeric yarn laid-in to a number of circular courses at least in the region of the ankle, the barrier component being corrugated or ruched, when the sock is in the unstretched state, so that it can accommodate circumferential stretching of the inner and outer socks on initial stretching thereof and being circumferentially elastic so as also to be able to stretch circumferentially on further circumferential stretching of the inner and outer socks, to at least 50% extension, the barrier component being constrained against stretching in the toe-to-calf longitudinal direction by the support fabric, and the laid in elastomeric yarn ensuring a close fit of the sock to the foot and leg of the wearer.

36. A composite sock as claimed in claim 35, wherein the composite sock consists of the inner sock, the barrier component and the outer sock, further wherein the barrier component consists of the membrane reinforced by the fabric support.

37. A method of making a composite sock which comprises circular knitting an inner sock to the desired size, the inner sock having elastic yarns laid-in in circumferential direction courses of the composite sock, drawing the inner sock onto an oversize first former, so that the inner sock is stretched circumferentially at the foot location (C), the ankle location (B), and the leg location (A) to at least 150% of its as-knitted size, providing a barrier component in the form of a bag, which is liquid water impermeable, and water vapour permeable, the barrier component being of the same shape but slightly greater size than the first former, such that it can be slipped over the inner sock on the said first former, dots of activatable adhesive being applied to or having been applied to the inner sock, or the barrier component, slipping the barrier component over the inner sock and activating the adhesive to attach the inner sock to the barrier component at spaced apart locations, removing the assembly from the first former, and treating the assembly to facilitate recovery of the inner sock to its as-knitted dimensions.

38. A method of making a composite sock which comprises circular knitting inner and outer socks to the desired size, drawing the inner sock onto an oversize first former so that the inner sock is stretched circumferentially at the foot location (C), the ankle location (B), and the leg location (A) to at least 150% of its as-knitted size, providing a barrier component in the form of a bag, which is liquid water impermeable, and water vapour permeable, the barrier component being of the same shape but slightly greater size than the first former, such that it can be slipped over the inner sock on the said first former, dots of activatable adhesive being applied to or having been applied to the inner sock, or the barrier component, slipping the barrier component over the inner sock and activating the adhesive to attach the inner sock to the barrier component at spaced apart locations, removing the assembly from the first former, and treating the assembly to facilitate recovery of the inner sock to its as-knitted dimensions, drawing the assembly over an oversize second former which has smaller values of (A), (B) and (C) than does the first former and which has a sock-like shape, the second former being such that the stretching of the inner sock at A, B and C is less than the stretching which occurred on the first former, dots of activatable adhesive being applied to or having been applied to the barrier component or to the outer sock, drawing the outer sock over the barrier component on the second former, and activating the adhesive to attach the barrier component to the outer sock at spaced apart locations, removing the completed sock from the second former, and treating the assembly to facilitate recovery of the inner and outer socks to their as-knitted dimensions.

39. A method as claimed in claim 38 in which the ratio of the percentage increase in A for the outer sock (AO) to A for the inner sock (AI) is in the range 0.2:1 to 0.9:1, the ratio of the percentage increase in B for the outer sock (BO) to B for the inner sock (BI) is in the range 0.2:1 to 0.9:1, and the ratio of the percentage increase in C for the outer sock (CO) to C for the inner sock (CI) is in the range 0.2:1 to 0.9:1.

40. A composite sock which comprises a sock, and a barrier component in the form of a bag which is liquid water impermeable, and water vapour permeable, the sock being attached to the barrier component, the attachment being such as to allow circumferential stretching of the sock, wherein the attachment is such as to allow circumferential stretching of the sock at least in the circumferential direction to at least 50% extension, and wherein the sock is a circular knit sock, the sock having elastic yarns laid-in in circumferential direction courses of the sock, so that the ability of the sock when stretched laterally to recover to, or towards, its original unstretched shape and dimensions is enhanced.

41. A composite sock as claimed in claim 40 wherein the barrier component is located outside the sock and wherein a second or outer knitted fabric is disposed over the outer surface of the barrier component and is attached thereto, the attachment being such as to allow circumferential stretching of the sock at least in the circumferential direction to at least 50% extension.

42. A composite sock as claimed in claim 40 wherein elastic yarns are laid-in to a number of circumferential direction courses at least in the region of the ankle.

43. A composite sock as claimed in claim 40 wherein the elastic yarns are laid-in throughout the sock.

44. A composite sock as claimed in claim 40 wherein the elastic yarns are laid-in to every circumferential direction course or every other circumferential direction course, at least in the region of the ankle or throughout the sock.

45. A composite sock as claimed in claim 40 wherein when a sample taken from the leg of the composite sock just above the ankle, the sample being 5 cm by 10 cm with the 10 cm dimension aligned in the circumferential direction, is extended on a tensometer at 100 mm per minute by 50% to 15 cms length, and the sample is allowed to recover at 100 mm/minute, producing a hysteresis curve, the load at 25% extension during the recovery stage, defined as the power rating, is at least 50% of the load at 25% extension during the stretching stage.

46. A composite sock as claimed in claim 45 wherein the load to stretch the sample in the circumferential direction to 50% extension is less than 15N per 5 cm width.

47. A composite sock as claimed in claim 45 wherein on release of the pulling load, in such a way that the sample recovers at 100 mm/minute, the sample recovers to within 12.5% of its original 10 cms length, defined as the recovery %.

48. A composite sock as claimed in claim 45 wherein the 50% extension load of the composite sock is less than 7.5N, the recovery % is to within 7.5% and the power rating is at least 60%.

49. A composite sock as claimed in claim 48 wherein the 50% extension load of the composite sock is less than 5N, the recovery % is to within 5% and the power rating is in the range 60 to 80%.

50. A composite sock as claimed in claim 40 wherein the barrier component comprises a liquid water impermeable, water vapor permeable membrane reinforced by a support fabric, the barrier component being corrugated or ruched in the unstretched state so that it can accommodate circumferential stretching of the sock on stretching thereof, the barrier component being constrained against stretching in the toe-to-calf longitudinal direction by the support fabric, which does not interfere with the circumferential expansion of the ruched barrier component.

51. A composite sock as claimed in claim 50 wherein the support fabric is extensible by less than 50% in the toe-to-calf or Y-direction.

52. A composite sock as claimed in claim 50 wherein the sock is a circular knitted sock and in that the membrane is reinforced by a support fabric, and wherein the outer surface of the sock is attached to the inner surface of the barrier component by spaced apart dots of adhesive, the membrane being attached to the support fabric by spaced apart dots of adhesive whereby the barrier component is constrained against stretching in the toe-to-calf longitudinal direction by the support fabric, and the laid-in elastic yarn ensures a close fit of the sock to the foot and leg of the wearer.

53. A composite sock as claimed in claim 50, wherein the barrier component consists of the membrane reinforced by the support fabric.

54. A composite sock as claimed in claim 40 wherein a second or inner knitted sock is disposed over the inner surface of the barrier component and is attached thereto, the attachment being such as to allow circumferential stretching of the sock at least in the circumferential direction to at least 50% extension.

55. A composite sock which comprises an inner stretchable fabric envelope, a barrier component in the form of a bag which is liquid water impermeable, and water vapour permeable, and a second or outer stretchable fabric envelope, the inner envelope being attached to the barrier component, the barrier component being attached to the outer envelope, the arrangement being such as to allow circumferential stretching of the composite sock, wherein the inner stretchable fabric envelope or the outer stretchable fabric envelope or both is a circular knitted sock, the composite sock has elastic properties such that it can be stretched at least in the circumferential direction to at least 50% extension, and such that when a sample taken from the leg of the composite sock just above the ankle, the sample being 5 cm by 10 cm with the 10 cm dimension aligned in the circumferential direction, is extended on a tensometer at 100 mm per minute by 50% to 15 cms length and the sample is allowed to recover at 100 mm/minute, producing a hysteresis curve, the load at 25% extension during the recovery stage is at least 50% of the load at 25% extension during the stretching stage.

56. A composite sock which comprises an inner stretchable sock, a barrier component in the form of a bag which is liquid water impermeable, and water vapour permeable, and an outer stretchable sock, the inner sock being attached to the barrier component, the barrier component being attached to the outer sock, the arrangement being such as to allow circumferential stretching of the composite sock, wherein the inner sock and the outer sock are circular knitted socks and wherein the inner or the outer sock or both have elastic properties such that the composite sock has elastic properties such that it can be stretched at least in the circumferential direction to at least 50% extension, and such that when a sample taken from the leg of the composite sock just above the ankle, the sample being 5 cm by 10 cm with the 10 cm dimension aligned in the circumferential direction, is extended on a tensometer at 100 mm per minute by 50% to 15 cms length;

(i) the load to stretch the sample in the circumferential direction to 50% extension is less than 15N per 5 cm width;

(ii) on release of the pulling load, in such a way that the sample recovers at 100 mm/minute, the sample recovers to within 12.5% of its original 10 cms length; and (iii) when the sample is allowed to recover at 100 mm/minute, producing a hysteresis curve, the load at 25% extension during the recovery stage is at least 50% of the load at 25% extension during the stretching stage.

57. A composite sock which comprises an outer sock, a barrier component in the form of a bag which is liquid water impermeable, and water vapour permeable, and a second or inner sock, the outer sock being attached to the barrier component, the second or inner sock being disposed over the inner surface of the barrier component and being attached thereto, the attachment being such as to allow circumferential stretching of the sock, wherein the attachment is such as to allow circumferential stretching of the sock at least in the circumferential direction to at least 50% extension, and wherein the outer sock is a circular knit sock, the outer sock having elastic yarns laid-in in circumferential direction courses of the composite sock, so that the ability of the composite sock when stretched laterally to recover to, or towards, its original unstretched shape and dimensions is enhanced.

* * * * *